US007065307B2

(12) United States Patent
Takahashi

(10) Patent No.: US 7,065,307 B2
(45) Date of Patent: Jun. 20, 2006

(54) IMAGE FORMING APPARATUS

(75) Inventor: Satoshi Takahashi, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 115 days.

(21) Appl. No.: 10/784,878

(22) Filed: Feb. 24, 2004

(65) Prior Publication Data

US 2004/0234286 A1 Nov. 25, 2004

(30) Foreign Application Priority Data

May 20, 2003 (JP) ..... 2003-141656

(51) Int. Cl.
*G03G 15/08* (2006.01)
*G03G 15/20* (2006.01)

(52) U.S. Cl. ..... 399/53; 399/70

(58) Field of Classification Search ..... 399/43, 399/53, 70

See application file for complete search history.

(56) References Cited

U.S. PATENT DOCUMENTS 4,970,557 A * 11/1990 Masuda et al. ..... 399/43
5,057,867 A * 10/1991 Ishigaki et al. ..... 399/43
5,666,627 A 9/1997 Yamaguchi
5,839,018 A * 11/1998 Asanuma et al. ..... 399/43
6,453,131 B1 * 9/2002 Sasai ..... 399/70
2003/0035657 A1 * 2/2003 Asano et al. ..... 399/53

FOREIGN PATENT DOCUMENTS

| | | |
|---|---|---|
| JP | 07-295414 | 11/1995 |
| JP | 10-039674 | 2/1998 |
| JP | 11-038700 | 2/1999 |
| JP | 11-125987 | 5/1999 |

* cited by examiner

*Primary Examiner*—Sandra L. Brase
(74) *Attorney, Agent, or Firm*—Finnegan, Henderson, Garrett & Dunner, L.L.P.

(57) ABSTRACT

An image forming apparatus is provided which while ensuring obtaining an appropriate quality of images enables shortening of the warming-up period of time for the apparatus as a whole. The preliminary rotation operations of a photosensitive body and developing unit, as well as the image correcting operation followed by forming images using a test image, is prohibited. Developing conditions are determined through an immediately preceding image correcting operation followed by the formation of an image. Thereby, predicted image correction is executed which corrects them according to the lapse time as counted from the completion of the immediately preceding image-formation processing as well as the environmental conditions (relative humidity). Thereby, it is arranged that, even after warming-up for fixing has finished, the apparatus is brought to be ready for use by a user.

9 Claims, 11 Drawing Sheets

FIG.7

400 DETERMINATION TABLE

| HUMIDITY OUTSIDE (%RH) | TIME PERIOD DURING WHICH TO ALLOW TO STAND (HR) | | | | | | |
|---|---|---|---|---|---|---|---|
| | 2 | 4 | 8 | 12 | 16 | 20 | 24 OR MORE |
| 90～100 | ○ | × | × | × | × | × | × |
| 80～89 | ○ | ○ | × | × | × | × | × |
| 70～79 | ○ | ○ | ○ | ○ | ○ | × | × |
| 60～69 | ○ | ○ | ○ | ○ | ○ | ○ | ○ |
| 59 OR LESS | ○ | ○ | ○ | ○ | ○ | ○ | ○ |

FIG.8

420 CORRECTION TABLE

| HUMIDITY OUTSIDE (%RH) | TIME PERIOD DURING WHICH TO ALLOW TO STAND (HR) | | | | |
|---|---|---|---|---|---|
| | 4 | 8 | 12 | 24 | NOT SMALLER THAN 48 |
| NOT LOWER THAN 70 | −0.05 | −0.05 | −0.1 | −0.15 | −0.15 |
| 30～69 | 0 | −0.05 | −0.05 | −0.1 | −0.1 |
| LOWER THAN 30 | 0 | 0 | −0.05 | −0.05 | −0.1 |

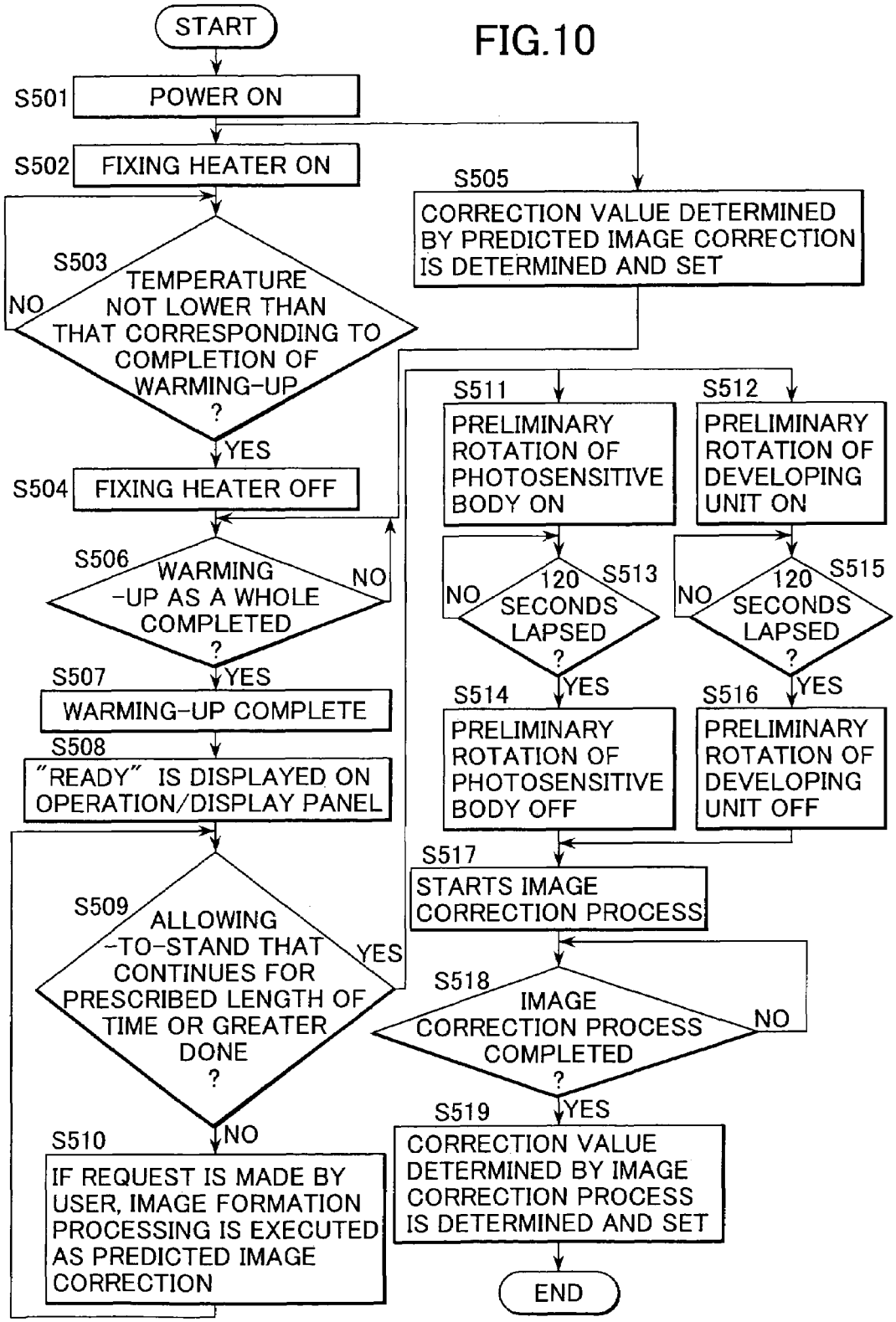
FIG.10
START
S501
POWER ON
S502
FIXING HEATER ON
S503
TEMPERATURE NOT LOWER THAN THAT CORRESPONDING TO COMPLETION OF WARMING-UP ?
NO
YES
S504
FIXING HEATER OFF
S506
WARMING -UP AS A WHOLE COMPLETED ?
NO
YES
S507
WARMING-UP COMPLETE
S508
"READY" IS DISPLAYED ON OPERATION/DISPLAY PANEL
S509
ALLOWING -TO-STAND THAT CONTINUES FOR PRESCRIBED LENGTH OF TIME OR GREATER DONE ?
YES
NO
S510
IF REQUEST IS MADE BY USER, IMAGE FORMATION PROCESSING IS EXECUTED AS PREDICTED IMAGE CORRECTION
S505
CORRECTION VALUE DETERMINED BY PREDICTED IMAGE CORRECTION IS DETERMINED AND SET
S511
PRELIMINARY ROTATION OF PHOTOSENSITIVE BODY ON
S512
PRELIMINARY ROTATION OF DEVELOPING UNIT ON
S513
120 SECONDS LAPSED ?
NO
YES
S515
120 SECONDS LAPSED ?
NO
YES
S514
PRELIMINARY ROTATION OF PHOTOSENSITIVE BODY OFF
S516
PRELIMINARY ROTATION OF DEVELOPING UNIT OFF
S517
STARTS IMAGE CORRECTION PROCESS
S518
IMAGE CORRECTION PROCESS COMPLETED ?
NO
YES
S519
CORRECTION VALUE DETERMINED BY IMAGE CORRECTION PROCESS IS DETERMINED AND SET
END

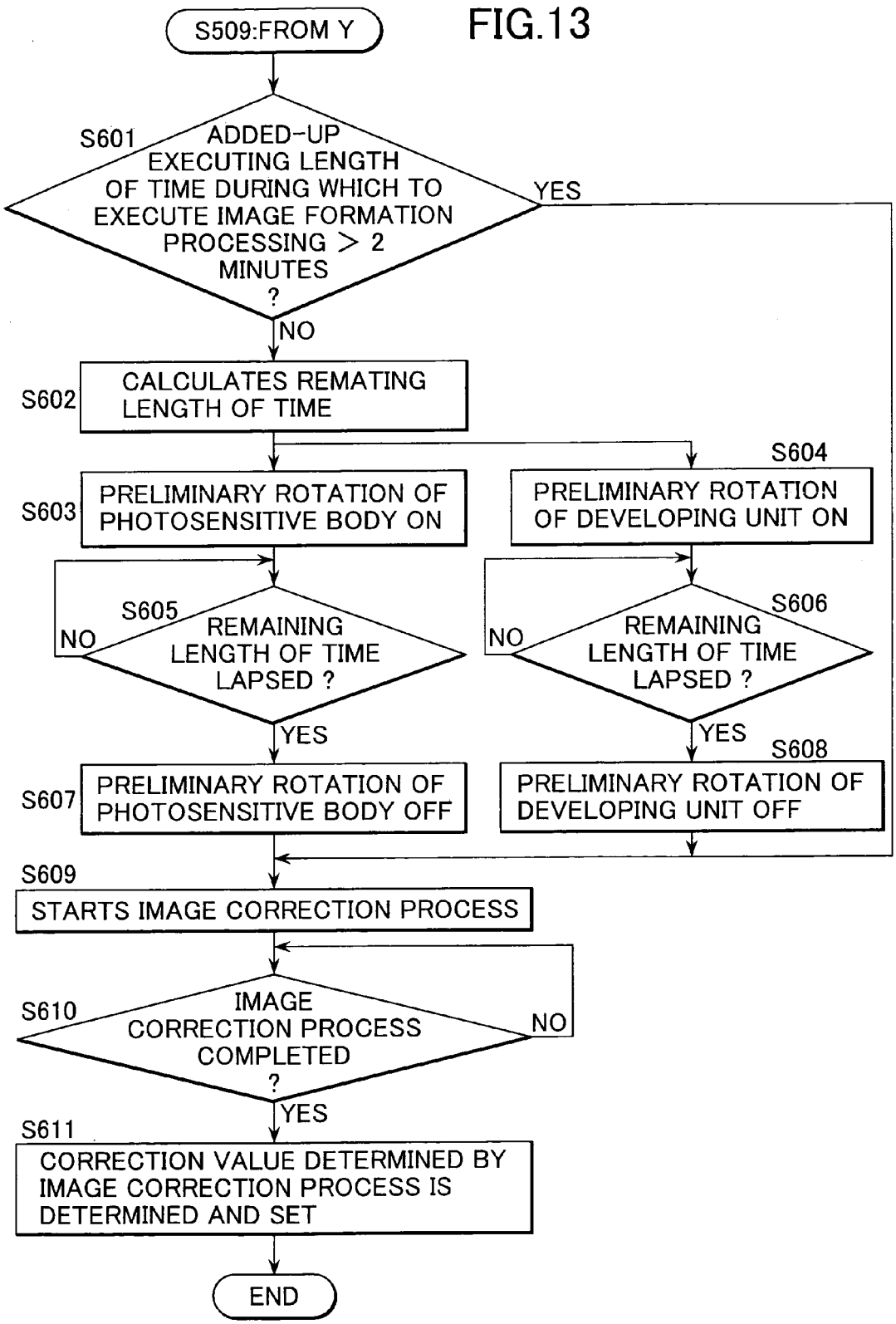
FIG.13
S509:FROM Y
S601
ADDED-UP EXECUTING LENGTH OF TIME DURING WHICH TO EXECUTE IMAGE FORMATION PROCESSING > 2 MINUTES ?
YES
NO
S602
CALCULATES REMATING LENGTH OF TIME
S603
PRELIMINARY ROTATION OF PHOTOSENSITIVE BODY ON
S604
PRELIMINARY ROTATION OF DEVELOPING UNIT ON
S605
REMAINING LENGTH OF TIME LAPSED ?
NO
YES
S606
REMAINING LENGTH OF TIME LAPSED ?
NO
YES
S607
PRELIMINARY ROTATION OF PHOTOSENSITIVE BODY OFF
S608
PRELIMINARY ROTATION OF DEVELOPING UNIT OFF
S609
STARTS IMAGE CORRECTION PROCESS
S610
IMAGE CORRECTION PROCESS COMPLETED ?
NO
YES
S611
CORRECTION VALUE DETERMINED BY IMAGE CORRECTION PROCESS IS DETERMINED AND SET
END

IMAGE FORMING APPARATUS

BACKGROUND OF THE INVENTION

1. Field of the Invention

The present invention relates to an image forming apparatus that uses an electro-photographic process, and more particularly to an image forming apparatus that enables shortening of the warming-up length of time for a fixing unit.

2. Description of the Prior Arts

In an image forming apparatus such as a digital type copying machine and a digital type composite machine wherein functions of a printer, facsimile, etc. are integrated in that copying machine, ordinarily, there is used a printer part that uses an electro-photographic process. In such image forming apparatus using the printer part, in many cases, a relatively long length of time is needed to execute warming-up after making the power ON. From a viewpoint of the convenience in use as well as energy saving, shortening of that length of time has hitherto been demanded and various kinds of techniques for meeting such demand have hitherto been developed.

For example, there is a technique that calculates from the size and the number of recording mediums a total area of the images that will be formed determines the temperature of the fixing unit that is needed to perform fixing with respect to that total area of image, and withdraws from heating to an extent that is greater than necessary, thereby achieving shortening the warming-up length of time (Japanese Patent Application Laid-Open (JP-A). No. 10-39674). Also, there is a technique that determines consuming amount of toner information from the thickness of an original document and the number of black dots in each original document, determines a temperature at which the toner is fixable according to that information, and, at the point of time when the temperature of the fixing machine has been raised up to this temperature, determines that warming-up is complete (JP-A No. 11-125987).

On the other hand, there is a technique that, in order to shorten the warming-up length of time, performs reduction in heat capacity (for example reduction in wall thickness) of the heating member for the fixing unit and that, as this heating part, uses an element that directly generates heat through the use of eddy current, thereby aiming to enhance the efficiency of heating. (JP-A No. 7-295414)

By the way, in the case of an electro-photographic type image forming apparatus, after an allowing-to-stand period of time has been done, as at the earliest time in the morning, for a long period of time without image formation processing being executed, the electrical chargeability of the developer and the photo-sensitivity characteristic of the photosensitive body become unstable. As a result of this, it was very likely that inconveniences in the quality of image such as excess in the image concentration and deficiency in the image concentration or collapse and getting out of sequence in the gradation would take place. These inconveniences in the quality of image are eliminated by performing the preliminary rotating operation for the photosensitive body and the preliminary agitating operation for the developer, by, after performing those preliminary operations, forming more than one visible image of a test image on the photosensitive body while changing the developing conditions, by detecting the concentrations of them, and by thereafter correcting the developing conditions so that an appropriate value of concentration is obtained.

Thereupon, there has been proposed an image forming apparatus that is configured so that the above-described preliminary operation and image correction operation are performed for several minutes that are required for the fixing warming-up operation (JP-A No. 11-38700). FIG. 1 illustrates the flow of operation for warming-up where image correction operation is executed during the fixing warming-up period of time. When the power for the apparatus is made ON (step S801), the fixing warming-up operation (step S802), preliminary rotation operation of the photosensitive body (step S803), and preliminary rotating operation of the developing unit (step S804) are executed in parallel. When the fixing unit has been heated up to a prescribed temperature at which warming-up is complete (for example 180° C.), the fixing warming-up operation is terminated (step S805; Y). Thereby, fixing heater is switched OFF (step S806).

The preliminary rotating operation for the photosensitive drum and that for the developing unit are complete (step S808 and step S810) after lapse of 120 seconds (step S807; Y and step S809; Y). Thereafter, an image correction process is performed to examine the developing conditions on which an appropriate concentration is obtained (steps S811 and S812) by forming more than one image of the test image on the photosensitive body by changing the developing conditions. When both of the fixing warming-up operation and image correction process steps have terminated and the whole warming-up operations have thereby completed (step S813; Y and step S814), a message such as "ready to copy" is displayed on the operation/display panel (step S815). As a result, the apparatus is brought to a state ready for use.

FIG. 2 illustrates the operational timings of respective parts of the image forming apparatus in a case where the image correction operation has terminated before completion of the fixing warming-up. The power is made ON at time T1 and the fixing warming-up starts at time T2 . At time T3, the preliminary rotating operations for the photosensitive body and developing unit starts. These preliminary rotating operations are terminated at T4 and, at time T5, the photosensitive body and developing unit rotate for formation of test images. From time T6 to time T7, image correction operation for forming visible images of test images while changing the developing conditions is executed. Upon cease of the rotations of the photosensitive body and developing at time T8, image correction operation is complete. Thereafter, at time T9, warming up of the fixing heater is terminated and, at this point of time, warming up of the apparatus as a whole is complete for the first time.

The apparatus illustrated in this example is designed so that importance is placed on ensuring the fixing capability for toner that is attained when performing consecutive printing of papers (approximately several hundreds of papers) that immediately follows warming-up and, to this end, the fixing rollers are increased in heat capacity and the accumulated amount of heat is thereby increased. For this reason, the warming-up length of time for the fixing unit is made greater than the added-up length of time that is needed for executing the preliminary rotating operations for the photosensitive body, etc. and the image correction operation. For this reason, even when preliminary rotating operations and image correction operation are executed, they are done by the point of time at which warming-up is complete. Namely, the warming-up length of time for the image forming apparatus as a whole falls within, and depends on, the warming-up length of time for the fixing heater. Therefore, the period of time until completion of the fixing warming-up operation is effectively utilized.

By applying the above-described various kinds of techniques and by somewhat victimizing ensuring the fixing capability in consecutively printing papers after warming-up, the fixing warming-up length of time is shortened. However, when the fixing warming-up length of time is shortened, as illustrated as an example in the timing chart of FIG. 3 the length of time that is taken for executing the preliminary rotating operations for the photosensitive body and developing unit and the image correction operation governs the warming-up length of time for the whole apparatus this time. For this reason, when the preliminary rotation for the photosensitive body and the image correction operation are executed for ensuring the appropriate quality of image, for example, at the earliest time of a day, in parallel with the fixing warming-up operation, whatever extent the fixing warming-up length of time is made short to, there was a problem that it was impossible to sufficiently shorten the warming-up length of time for the whole apparatus.

SUMMARY OF THE INVENTION

The present invention has been made in consideration of the above-described points of problem and has an object to provide an image forming apparatus that while ensuring obtaining an appropriate quality of image enables shortening of the warming-up period of time for the apparatus as a whole.

To attain the above object, the subject matter of the invention resides in the following aspects of the invention.

A first aspect of the present invention provides an image forming apparatus adapted to execute a series of image formation processing in such a way as to develop and make visible an electrostatic latent image that has been formed on an electrostatic latent image carrier 43 by using a developer layer that is carried on a developer carrier 52, to transfer the visualized image onto a recording medium 2, thereafter to eliminate the developer remaining on the electrostatic latent image carrier 43 by using a cleaning unit 48, and to pass the post-transfer recording medium 2 through fixing means 80 for heating and pressurizing it to thereby perform-adhering and fixing of the image, which comprises predicted image correction means 111 that corrects the developing conditions that are used when visualizing the electrostatic latent image on the electrostatic latent image carrier 43 according to the length of time that has lapsed since an immediately preceding image formation processing was executed or that length of time and the environmental conditions.

According to the above-described aspect of the invention, the predicted image correction means 111 corrects the developing conditions that are used when making visible the electrostatic latent image on the electrostatic latent carrier 43 according to the passage of time as counted after executing the immediately preceding image formation processing or this passage of time and the environmental conditions. As a result of this, compared to executing the image correction operation using a test image, the length of time required for correcting the developing conditions is shortened. Correcting by the predicted image correction means 111 is effective, for example, in a case where executing the image formation processing immediately after finish of the fixing warming-up that follows making the power ON. Also, even during the time period in which the power is made ON, if correction is applied to the image formation processing that follows a long allowing-to-stand of the apparatus, it becomes possible to obtain an appropriate quality of output image without keeping the user waiting long.

A second aspect of the present invention provides an image forming apparatus adapted to execute a series of image formation processing in such a way as to develop and make visible an electrostatic latent image that has been formed on an electrostatic latent image carrier 43 by using a developer layer that is carried on a developer carrier 52, to transfer the visualized image onto a recording medium 2, thereafter to eliminate the developer remaining on the electrostatic latent image carrier 43 by using a cleaning unit 48, and to pass the post-transfer recording medium 2 through fixing means 80 for heating and pressurizing it to thereby perform adhering and fixing of the image, which comprises predicted image correction means 111 that corrects the developing conditions that are used when visualizing the electrostatic latent image on the electrostatic latent image carrier 43 according to the length of time that has lapsed since an immediately preceding image formation processing was executed or that length of time and the environmental conditions; and control means 100 that controls the flow of operation associated with the correction of the images, whereby the control means 100 prohibits, during warming-up of the fixing means 80, one, or a plurality of, or all, operations of an actual measurement image correction operation that forms a visualized test image on the electrostatic latent image carrier 43 and that, according to that test image, corrects the developing conditions that are used when visualizing the electrostatic latent image formed on the electrostatic latent image carrier 43, a preliminary rotation operation for the electrostatic latent image carrier 43, and a preliminary agitating operation for the developer, thereby executing the image formation processing following the completion of warming-up of the fixing means 80 by using a value of correction that is determined by the predicted image correction means 111.

According to the above-described aspect of the invention, instead of prohibiting during the fixing warming-up one, or a plurality of, or all, operations of the preliminary rotation operation for the electrostatic latent image carrier 43, preliminary agitating operation for the developer, and actual measurement image correction operation for correcting the developing conditions according to the test image, it is arranged to execute the image formation processing following the completion of warming-up of the fixing means 80 using the value of correction by the predicted image correction means 111. By prohibiting the above-described operations, the warming-up length of time for the entire apparatus is governed by the fixing warming-up length of time. Therefore, shortening the fixing warming-up length of time enables shortening the warming-up length of time for the entire apparatus. Also, since executing the image formation processing using the value of correction by the predicted image correction means 111, the degradation in the quality of output image is prevented.

A third aspect of the present invention provides an image forming apparatus, the image forming apparatus adapted to execute a series of image formation processing in such a way as to develop and make visible an electrostatic latent image that has been formed on an electrostatic latent image carrier 43 by using a developer layer that is carried on a developer carrier 52, to transfer the visualized image onto a recording medium 2, thereafter to eliminate the developer remaining on the electrostatic latent image carrier 43 by using a cleaning unit 48, and to pass the post-transfer recording medium 2 through fixing means 80 for heating and pressurizing it to thereby perform adhering and fixing of the image, which comprises actual measurement image correction means 112 that forms a visualized test image on the electrostatic latent image carrier 43 and that, according to that test image, corrects the developing conditions that are used when visualizing the electrostatic latent image formed on the electrostatic latent image carrier 43; predicted image correction means 111 that corrects the developing conditions according to the length of time that has lapsed since an immediately preceding image formation processing was executed or that length of time and the environmental conditions; and control means 100 that controls the flow of operation associated with the correction of the images, whereby the control means 100 prohibits, during warming-up of the fixing means 80, one, or a plurality of, or all, operations of a preliminary rotation operation for the electrostatic latent image carrier 43, a preliminary agitating operation for the developer, and an image correction operation performed by the actual measurement image correction means 112, and, when, after completion of warming-up of the fixing means 80, an allowing-to-stand period of time during which no image formation processing is performed or inputting an operation or inputting a from-outside printing command is not performed has first continued for a prescribed, or greater than prescribed, length of time, executes the image correction operation, or either one, or both, of the preliminary rotation operation and preliminary agitation operation and executes the image formation processing during the period from completion of warming-up of the fixing means 80 until execution of the image correction operation by using a value of correction that is determined by the predicted image correction means 111.

According to the above-described aspect of the invention, during warming up the fixing means 80, the preliminary rotation operations and the image correction operation executed by the by-actual-measurement correction means 112 are prohibited. When thereafter an allowing-to-stand period of time that continues for a prescribed, or greater than prescribed, length of time has occurred for the first time, preliminary rotation operation and image correction operation are executed. Also, during a time period from the completion of the warming-up the fixing means 80 to the execution of the image correction operation, image formation processing is executed using the value of correction by the predicted image correction means 111. When the allowing-to-stand status has continued for a prescribed, or greater than prescribed, length of time, it is assumed that the possibility that the user will immediately request executing the image formation processing be low. On that account, if executing the image correction operation, etc. when that status has occurred, the image correction operation can be executed without keeping the user waiting. As far as concerning after that, it is possible to execute the image formation processing using the value of correction that has been obtained by the image correction operation.

A fourth aspect of the present invention provides an image forming apparatus that is the one according to the third aspect, and wherein in a case where, before the allowing-to-stand length of time has first continued for the prescribed, or greater than prescribed, length of time, image formation processing is executed using the value of correction that is determined by the predicted image correction means 111, the executing length of time for the preliminary rotation operation and/or preliminary agitating operation following the image correction operation is shortened.

Namely, even during executing the image formation processing using the value of correction by the predicted image correction means 111, the rotation of the electrostatic latent image carrier 43 and the agitating operation for the developer are executed. And, therefore, to that extent, the executing length of time for the preliminary rotation operation and preliminary agitating operation following the thereafter-succeeding image correction operation is shortened. As a result of this, the time period required until completing the image correction operation is shortened, and the possibility that executing the image formation processing will be requested from the user during that time period decreases.

A fifth aspect of the present invention provides an image forming apparatus, the image forming apparatus being adapted to execute a series of image formation processing in such a way as to develop and make visible an electrostatic latent image that has been formed on an electrostatic latent image carrier 43 by using a developer layer that is carried on a developer carrier 52, to transfer the visualized image onto a recording medium 2, thereafter to eliminate the developer remaining on the electrostatic latent image carrier 43 by using a cleaning unit 48, and to pass the post-transfer recording medium 2 through fixing means 80 for heating and pressurizing it to thereby perform adhering and fixing of the image, which comprises actual measurement image correction means 112 that forms a visualized test image on the electrostatic latent image carrier 43 and that, according to that test image, corrects the developing conditions that are used when visualizing the electrostatic latent image formed on the electrostatic latent image carrier 43; predicted image correction means 111 that corrects the developing conditions according to the length of time that has lapsed since an immediately preceding image formation processing was executed or that length of time and the environmental conditions; and control means 100 that controls the flow of operation associated with the correction of the images, whereby the control means 100 prohibits, during warming-up of the fixing means 80, one, or a plurality of, or all, operations of a preliminary rotation operation for the electrostatic latent image carrier 43, a preliminary agitating operation for the developer, and an image correction operation performed by the actual measurement image correction means 112, and includes a first warming-up mode in which to execute the image formation processing following the completion of warming-up of the fixing means 80 by using a value of correction that is determined by the predicted image correction means 111 and a second warming-up mode in which to execute the image correction operation or the image correction operation followed by either one, or both, of the preliminary rotation operation and the preliminary agitating operation, and selects in which mode the apparatus should be started up according to the time length that has lapsed since an immediately preceding image formation processing was executed as well as the environmental conditions.

According to the above-described aspect of the invention, it is determined, according to the lapse of time following executing the immediately preceding image formation processing as well as the environmental conditions, whether the value of correction by the predicted image correction means 111 should be used by prohibiting the image correction operation, etc. during the fixing warming-up operation or whether the image correction operation, etc. should be executed during the fixing warming-up. For example, the degradation in the quality of image in a case where a long allowing-to-stand is done under the environment of high humidity is not improved by correcting the developing conditions. Namely, this degradation is not recovered unless the electrostatic latent image carrier 43 is actually rotated and the portion of water is thereby eliminated with the cleaning blade. Thereupon, whether the degradation in the quality of image unable to be solved by the developing conditions occurs is estimated according to the length of the allowing-to-stand time period and to the environmental conditions. By doing so, selecting the mode of operation during warming-up for fixation is carried out.

A sixth aspect of the present invention provides an image forming apparatus which is the one according to the second, third, fourth, or fifth aspect and wherein the power that plans to be spent for warming up the fixing means 80 is increased by the extent to which there are prohibited, during warming up the fixing means 80, one, or a plurality of, or all, operations of the preliminary rotation operation for the electrostatic latent image carrier 43, the preliminary agitating operation for the developer, and the image correction operation executed by the actual measurement image correction means 112.

According to the above-described aspect of the invention, by supplying a larger amount of power to the fixing means 80 during the fixing warming-up, it is possible to shorten the fixing warming-up length, itself, of time. If using the value of correction by the predicted image correction means 111, since the warming-up for the entire apparatus is governed by the fixing warming-up, it is possible to further shorten the warming-up time period for the entire apparatus by shortening the fixing warming-up length of time.

A seventh aspect of the present invention provides an image forming apparatus which is the one according to the second, third, fourth, fifth, or sixth aspect and wherein the preliminary rotation operation for the electrostatic latent image carrier 43 is executed during warming up the fixing means 80.

According to the above-described aspect of the invention, the preliminary rotation operation is executed during the fixing warming-up time period. The degradation in the quality of image in the case where a long allowing-to-stand has been done under the environment of high humidity cannot be corrected by the developing conditions. It is recovered for the first time when actually rotating the electrostatic latent image carrier 43. Also, even in a case where the rotation length of time for the electrostatic latent image carrier 43 is impossible to sufficiently ensure, the effect of improving the quality of images can be expected at a level that corresponding to the rotation length of time. On the other hand, when executing the preliminary agitating operation for the developer during the fixing warming-up, in a case where that length of time is not sufficient, the electrical chargeability of the developer becomes unstable. As a result, estimating an optimum amount of correction that is obtained by the predicted image correction becomes difficult. For these reasons, it is preferable to execute during the fixing warming-up the preliminary rotation operation for the electrostatic latent image carrier 43 from which obtaining the effect of improving the quality of image can be expected.

An eighth aspect of the present invention provides an image forming apparatus that is the one according to the first, second, third, fourth, fifth, sixth, or seventh aspect and which further comprises actual measurement image correction means 112 that forms a visualized test image on the electrostatic latent image carrier 43 and that, according to that test image, corrects the developing conditions that are used when visualizing the electrostatic latent image formed on the electrostatic latent image carrier 43, whereby the predicted image correction means 111 corrects the developing conditions according to the immediately preceding value of correction that was previously determined by the actual measurement image correction means 112.

According to the above-described aspect of the invention, the predicted image correction means 111 corrects the developing conditions in accordance with the immediately preceding value of correction by the actual measurement image correction 112. By this, it is possible to enhance the accuracy of correction by the predicted image correction means 111.

A ninth aspect of the present invention provides an image forming apparatus that is the one according to the first, second, third, fourth, fifth, sixth, seventh, or eighth aspect and wherein the predicted image correction adjusts the amount of correction according to the length of time for which image formation processing has been executed using the value of correction that is previously determined by the predicted image correction means 111 itself.

According to the above-described aspect of the invention, the amount of correction by the predicted image correction is adjusted according to the length of the period in which there has been executed the image formation processing that uses the value of correction by the predicted image correction means 111. Since during executing the image formation processing, not only is the electrostatic latent image carrier 43 rotated but also the developer is agitated, the amount of electric charge involved in the developer gradually increases. Thereupon, by adjusting the amount of correction by taking into consideration the increase in the amount of electric charge that enters the developer, which corresponds to the executing length of time for the image formation processing, more appropriate predicted image correction becomes possible. Also, when the amount of correction has become zero "0", the image correction using the predicted image correction means 111 can be terminated.

BRIEF DESCRIPTION OF THE DRAWINGS

FIG. 7 is an explanatory view illustrating a determination table that the image forming apparatus according to the embodiment of the present invention stores therein;

FIG. 8 is an explanatory view illustrating an example of a correction table that the image forming apparatus according to the embodiment of the present invention stores therein;

FIG. 10 is a flow chart illustrating the operation such as warming-up operation that, after the power is made "ON", is performed by the image forming apparatus according to a second embodiment of the present invention;

FIG. 13 is a flow chart illustrating the operation of the image forming apparatus according to a third embodiment of the present invention.

DETAILED DESCRIPTION OF THE PREFERRED EMBODIMENTS

Various kinds of embodiments of the present invention will hereafter be explained.

Figure 5:
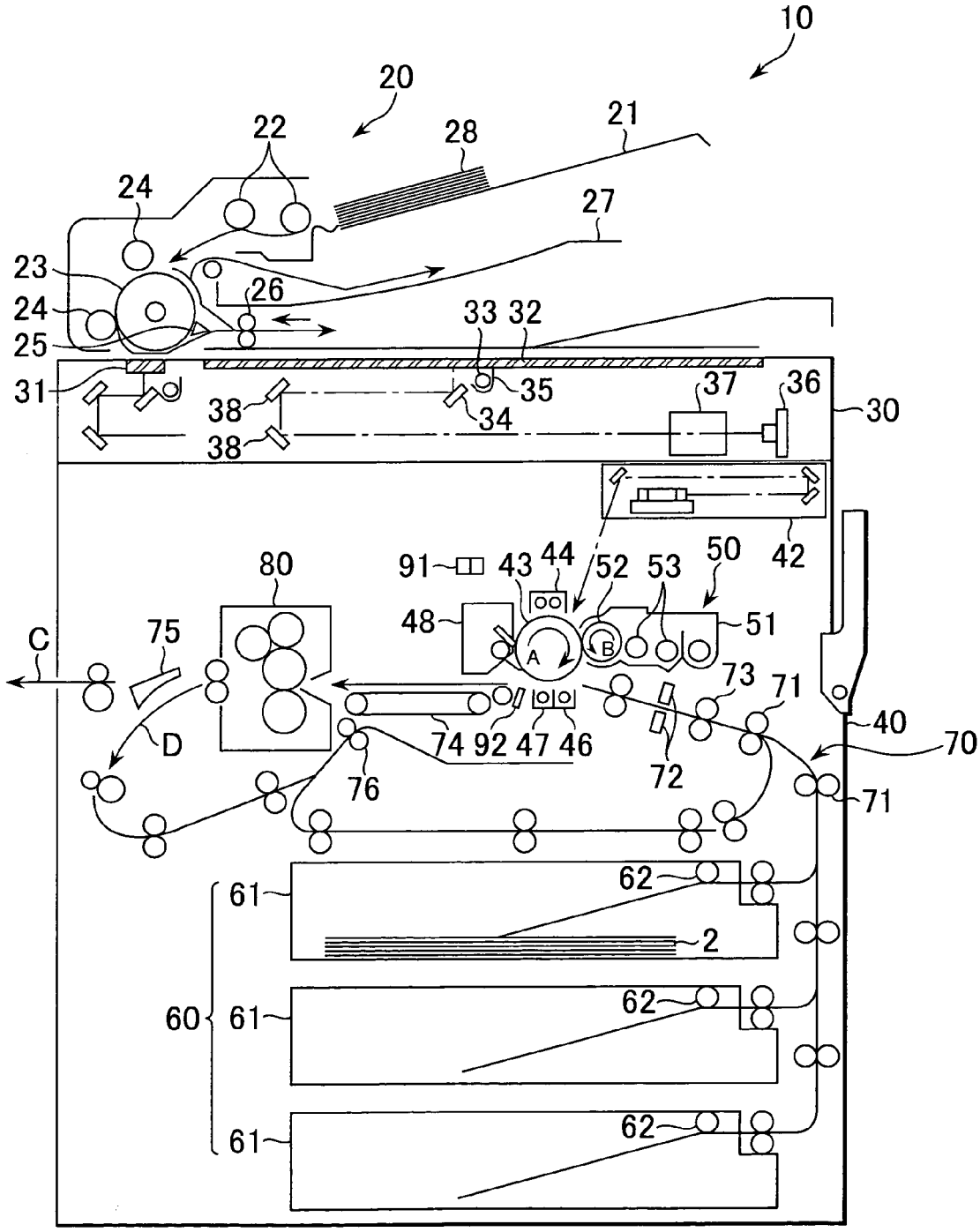
FIG. 5 is an explanatory view illustrating a sectional construction of the image forming apparatus according to the embodiment of the present invention.

FIG. 5 illustrates a sectional construction of an image forming apparatus 10 according to a first embodiment of the present invention. The image forming apparatus 10 is an apparatus named "a digital copier". It has a copying function to read therein an original document and to form this copied image onto a transfer sheet of paper.

The image forming apparatus 10 is constructed of an automatic original-document feed unit 20, reading unit 30, and printer unit 40. The automatic original-document feed unit 20 functions to feed an original document 28, which has been loaded on an original-document loading tray 21, into a portion of reading of the reading unit 30 on sheet by sheet basis. Also, regarding a double-faced original document, the feed unit 20 functions, after reading a one-side face of it, to reverse it and to feed it into the reading unit 30 again.

The automatic original-document feed unit 20 includes paper-feeding rollers 22 that sequentially feed out sheets of original document stacked on the original-document loading tray 21 from the uppermost sheet of original document, a close-contact roller 23 that while causing the sheet of original document to make close contact with a contact glass 31 that is the portion of reading for original document permits the sheet to pass, and a guide roller 24 that along the close-contact roller 23 guides the sheet of original document that has been fed in by the paper-feeding rollers 22. The automatic original-document feed unit 20 further includes a switching claw 25 that switches the advancing direction of the sheet of original document that has passed by the contact glass 31, inversion rollers 26 for inverting the double-faced original document from its obverse surface to its reverse surface or vice versa, and a paper discharge tray 27 onto which the sheet of original document, the reading from which has finished being done, is discharged.

In case of a double-faced original document, after it is fed to the close-contact roller 23 and is passed on and by the contact glass 31, it is guided, by the switching claw 25, so that it passes between the pair of rollers 26. And, immediately before a terminating end of the sheet of original document reaches the inversion rollers 26, the rotation direction of the inversion roller 26 is reversed, with the result that the sheet of original document is delivered toward the upside of the close-contact roller 23. As a result of this, the obverse and reverse surfaces of the sheet of original document are inverted. The sheet of original document that was fed to the close-contact roller 23 and has been passed on and by the contact glass 31 again is guided, this time, by the switching claw 25, toward the paper discharge tray 27 and is discharged. In case of a single-sided original document, a sheet of original document that has been fed out from the original-document-loading tray 21 is passed on the contact glass 31 along the close-contact roller 23. Thereafter, it is guided toward the paper discharge tray 27 as it stands and then is discharged.

The reading unit 30 includes, on its upper surface, the contact glass 31 that serves as the portion of reading for the sheet of original document that has been fed in by the automatic original-document feed unit 20 and a platen glass 32 on which the sheet of original document is manually placed by the user.

Below the contact glass 31 and platen glass 32, there is disposed an exposure/scanning unit 35 that includes a light source 33 and a mirror 34. The exposure/scanning unit 35 is constructed so that it is movable, by driving means not illustrated, along the underside of the platen glass 32. When reading the original document that has been fed in by-the automatic original-document feed unit 20, the exposure/scanning unit 35 is moved right beneath the contact glass 31. The light source 33 radiates the sheet of original document through the constant glass 31 and platen glass 32. The mirror 34 received the light reflected from the sheet of original document and functions to make the advancing path of that reflected light substantially parallel with the platen glass 32.

Also, the reading unit 30 includes a line sensor 36 that receives the reflected light from the original document and outputs an electric signal that corresponds to the intensity of that reflected light, a condensing lens 37 that condenses the reflected light from the original document into the line sensor 36, and various kinds of mirrors 38 that form an optical path for guiding to the line sensor 36 the reflected light from the mirror 34 of the exposure/scanning unit 35. The line sensor 36 is constructed of, for example, a number of CCD elements.

The printer unit 40 functions to record image data onto a transfer paper serving as a recording medium using an electrophotographic technology. The printer unit 40 includes a laser unit 42 that outputs a laser light that goes on and off in corresponding relationship to the image data. The laser unit 42 is constructed of a laser diode, polygon mirror, various kinds of lenses, mirror, and soon. The printer unit 40 includes a photosensitive drum 43, serving as an electrostatic latent image carrier, that has an electrostatic latent image formed on its surface by being exposed to a laser light from the laser unit 42, an electric charger 44 that is disposed in the neighborhood of it, a developing unit 50, a transferring unit 46, a separating unit 47, and a cleaning unit 48.

The photosensitive drum 43 is in the form of a circular cylinder and is rotated, by a driving part not illustrated, in a prescribed direction (the arrow-A-indicated direction in the figure). The electric charger 44 functions to electrically charge the photosensitive drum 43, uniformly, using corona discharge. The laser light that goes on and off in corresponding relationship to image data scans the surface of the photosensitive drum 43 that has uniformly been electrically charged like that. This forms an electrostatic latent image on the surface of the photosensitive drum 43. The developing unit 50 functions to make the electrostatic latent image formed on the surface of the photosensitive drum 43 an apparent image using a toner. The developing unit 50 includes a main-body case 51 that is equipped with a slit that faces the photosensitive drum 43 and that extends in the width direction thereof, a developing sleeve 52 that is accommodated within the main-body case 51 and that is in the form of a circular cylinder, an agitator 53 that stirs the toner within the main-body case 51, and a driving part not illustrated. This driving part rotates the developing sleeve 52 in the arrow-B-indicated direction in the figure. The photosensitive drum 43 and developing sleeve 52 are designed so that, at the portion of slit of the main-body case 51, they make relative movements at a speed that corresponds to the difference between the speed in the direction tangential to the photosensitive drum 43 and the speed in the direction tangential to the developing sleeve 52.

Also, the driving part of the developing unit 50 drives the agitator 53 for rotation. Due to the agitating operation of the agitator 53, the toner within the developing unit 50 is electrically charged and simultaneously uniformly adheres to the surface of the developing sleeve 52 that is kept rotating. The toner that has adhered to the surface of the developing sleeve 52 comes near to the photosensitive drum 43 at the portion of slit. As a result of this, the electrostatic latent image that was formed on the surface of the photosensitive drum 43 is made an apparent image due to the movement of the toner from the developing sleeve 52.

The transferring unit 46 functions to transfer the toner image on the surface of the photosensitive drum 43 onto a transfer sheet of paper by applying an electric field to it while, on the other hand, the separating unit 47 functions to separate the transfer sheet of paper from the photosensitive drum 43 by de-electrification. The cleaning unit 48 functions to eliminate the toner remaining on the photosensitive drum 43 by rubbing it off from the drum 43 by means of a blade or the like, for recovery. The toner that has been recovered is moved back to the developing unit 50 through a path not illustrated.

The printer unit 40 includes a paper supply unit 60 that supplies a transfer sheet of paper, a transfer paper conveying unit 70 that conveys the transfer sheet of paper that has been supplied, so that it passes through the portion of transfer between the photosensitive drum 43 and the transferring unit 46, and a fixing unit 80 that pressurizes and heats the toner image that has been formed on the transfer sheet of paper to fix it onto the surface of this transfer paper. The paper supply unit 60 includes a plurality of paper supply cassettes 61 each of that ordinarily accommodates therein a different size or type of transfer sheets of paper.

In the neighborhood of an exit of each paper supply cassette 61, there is disposed a first paper supply roller 62 that delivers the uppermost one of the transfer sheets of paper accommodated in the paper supply cassette 61, sheet by sheet, toward the transfer paper conveying unit 70. In the transfer paper conveying unit 70, there are disposed at intervals each of that is shorter than the size in the feed direction of feeding a transfer sheet of paper whose size is the smallest a number of conveying rollers 71. In the transfer paper conveying unit 70, at a position that is a little before the advancing transfer sheet of paper reaches the portion of transfer between the photosensitive drum 43 and the transferring unit 46, there is located a forward-end sensor 72 for detecting a forward end of the transfer sheet of paper. And, at a position that is a little before that position is arrived at, there are second paper supply rollers 73.

In a case where image data of the next page is not regularly arranged, the transfer sheet of paper that was supplied from the paper supply cassette 61 once stops immediately before the location of the second paper supply rollers 73. At the point of time when the image data has become regularly arranged, conveyance of that transfer sheet of paper is started again. Also, with a timing at which the forward-end sensor 72 has detected the forward end, forming an electrostatic latent image using the laser unit 42 is performed. On the downstream side of the separating unit 47, there is disposed a conveying belt 74 that conveys the transfer sheet of paper that was separated from the photosensitive drum 43, to the fixing unit 80.

On the rear side of the fixing unit 80, there is disposed an advancing-path-switching pawl 75 that switches the advancing path for the transfer sheet of paper that was passed through the fixing unit 80. When the advancing-path-switching pawl 75 is laid horizontal as indicated in a dotted line in the figure, the transfer sheet of paper after it was fixed is discharged to outside the machine as indicated by the arrow C. When the advancing-path-switching pawl 75 is laid slantwise as indicated in a solid line in the figure, the transferred sheet of paper advances in the arrow-D-indicated direction. Then, after the obverse and reverse surfaces of it are inverted, it is moved back to a position that is somewhat upstream from the second paper supply rollers 73. Then, recording with respect to the reverse surface is performed. Inversion of the transferred sheet of paper is performed in the same way as in the case of the automatic original-document feed unit 20. Namely, the transferred sheet of paper that has been carried on from the fixing unit 80 advances in such a way as to pass between an inverting pair of rollers 76. Then, immediately before a terminating end portion of it reaches the inverting rollers 76, the rotation direction of these inverting rollers 76 is reversed. Thereby, the transferred sheet of paper is inverted. Incidentally, the image forming apparatus 10 has a humidity sensor 91 that detects relative humidity outside or inside the machine. Also, at a position that is near, and sideward of, the separating unit 47, there is disposed a concentration detecting means 92 that detects the concentration of the toner image formed on the photosensitive drum 43. The concentration-detecting means 92 is a reflected-light type photo-sensor that radiates a light onto the photosensitive drum 43 and detects this light that has been reflected.

Figure 6:
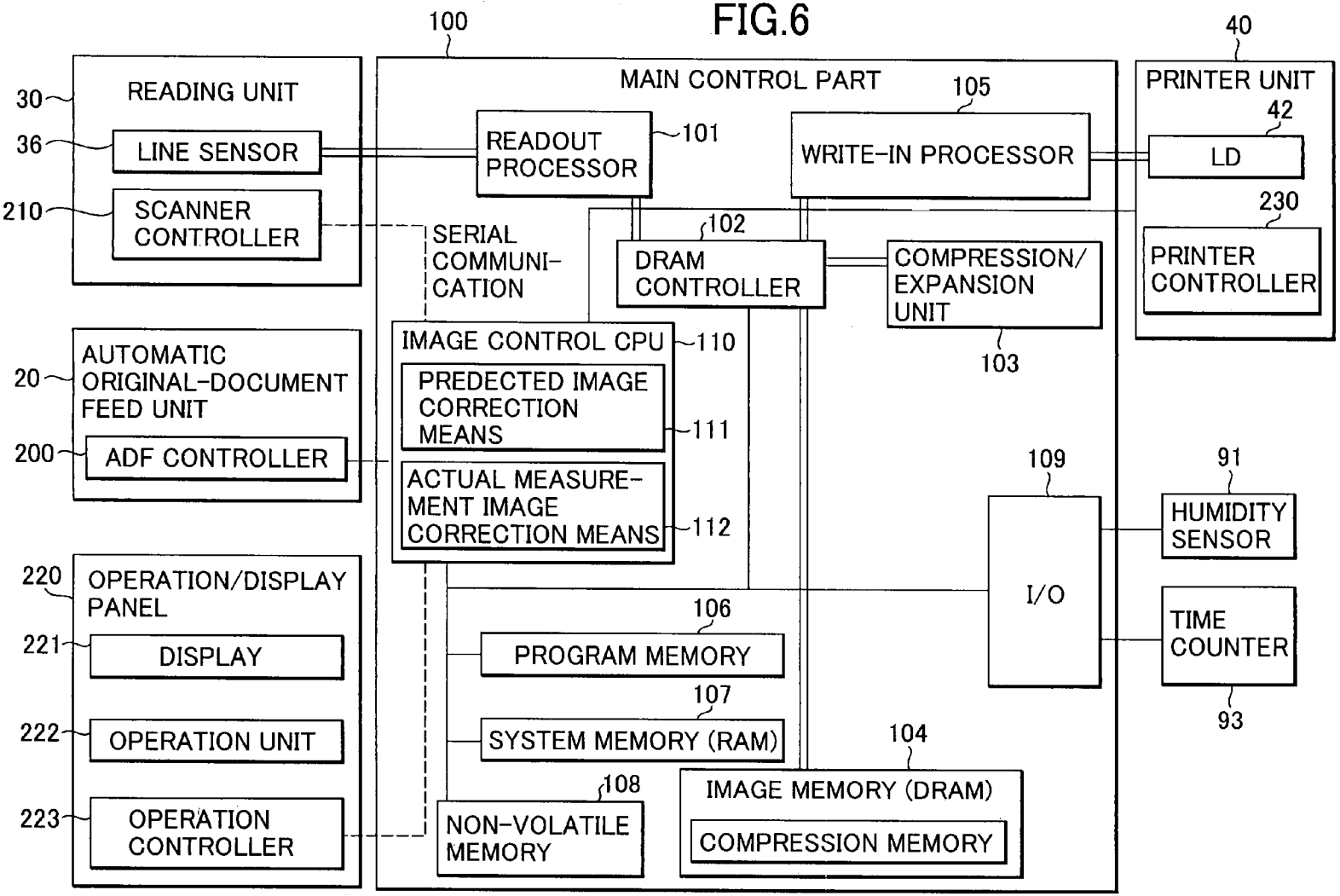
FIG. 6 is a block diagram illustrating an electrical construction of the image forming apparatus according to the embodiment of the present invention.

FIG. 6 is a block diagram illustrating an electrical construction of the image forming apparatus 10. The automatic original-document feed unit 20 includes an ADF control part 200 that performs control of a driving part not illustrated, etc. The reading unit 30 includes the line sensor 36 and a scanner controller 210. The scanner controller 210 performs on/off control with respect to the light source 33, movement control with respect to the exposure/scanning part 35, etc. An operation/display panel 220 functions to receive an instructing operation from the user and to display various kinds of information with respect to the user. The operation/display part 220 includes a display 221 that is comprised of a liquid crystal display, an operation unit 222 that is comprised of a touch switch that is laid on that screen, other switches, etc., and an operation control unit 223 that controls the operations of the display 221 and operation unit 222.

The printer unit 40 includes the laser unit 42 and a printer controller 230. The printer controller 230 performs on/off control with respect to a laser diode that the laser unit 42 has as well as rotation control with respect to the polygon mirror. Also, the printer controller 230 functions to perform general control over the application of a voltage to the electric charger 44, transferring unit 46, and separating unit 47, the rotation of the photosensitive drum 43, and the operations of the developing unit 50, cleaning device 48, fixing unit 80, paper supply unit 60, and transfer paper conveying unit 70. A respective one of the ADF controller 200, scanner controller 210, operation controller 223, and printer controller 230 is constructed of a CPU and a circuitry including a ROM and RAM as its main unit. And, each unit executes its relevant kind of control according to the program stored in the ROM.

The main controller 100 functions to perform general control over the operations of the image forming apparatus 10. In greater details, it controls the warming-up operation after the power is made "ON", the image forming processing operation when an original document is copied, etc. The main controller 100 includes a reading-out processor 101, a DRAM control part 102, a compression/expansion unit 103, an image memory 104, a writing-in processor 105, an image control CPU 110, a program memory 106, a system memory 107, a non-volatile memory 108, and an I/O port 109.

The reading-out processor 101 functions to perform enlargement processing, imaging processing, binarization processing using error diffusion, etc. with respect to image data that the reading-out unit 30 outputs. The compression/expansion unit 103 functions to compress image data that has been binarized and to expand the data that has been compressed. The image memory 104 functions as a page memory that can store non-compressed image data in units of a page and functions as a compression memory that accumulates image data that has been compressed. The writing-in processor 105 functions to send the image data, which has been read out from the image memory 104 and then expanded, out to the laser unit 42 with a timing that corresponds to the operation that the printer unit 40 performs. The DRAM controller 102 performs timing control for read/write and refresh with respect to the image memory 104 that consists of a dynamic RAM, performs timing control for compressing image data and storing it into the image memory 104 as well as timing control for reading out compressed data from the image memory 104 for expanding it in the compression/expansion unit 103, and so forth.

The image control CPU 110 controls over-all operation of the image forming apparatus 10. It functions to perform job management and to manage the flow of the image data. Also, the image control CPU 110 functions as predicted image correction means 111 and as actual measurement image correction means 112. The predicted image correction means 111 functions to use the developing conditions under which an electrostatic latent image that was formed on the photosensitive drum 43 is visualized as a toner image using the developing unit 50. It then functions to correct those developing conditions according to a time passage that exists after an immediately preceding image formation processing was executed or that time passage and the environmental conditions. The actual measurement image correction means 112, after the toner image of a test image was formed on the photosensitive drum 43, functions to actually measures the concentration of that test image using the concentration detecting means 92. It then functions to correct the developing conditions so that an appropriate level of concentration is obtained.

Here, the developing conditions mean the ratio (hereinafter called "the speed ratio") between the rotation speed (the speed as measured in the tangential direction) of the developing sleeve 52 and the rotation speed (the speed as measured in the tangential direction) of the photosensitive drum 43, as well as the developing electric field (the potential difference between the potential of the developing sleeve 52 and that of the photosensitive drum 43 that is blacked all over). Correcting the developing conditions is performed by adjusting any one, or both, of those speed ratio and developing electric field.

The program memory 106 is a memory in which there is stored a program for executing the image control CPU 110 while the system memory 107 is a work memory for temporarily storing various kinds of data during execution of the program. In the non-volatile memory 108 there is stored various kinds of information. For example, there are stored in it the most recent developing conditions that have been obtained through the actual measurement image correction, the time and day information that indicates when the power was made "OFF", the history of changes in the relative humidity that the humidity sensor 91 detects, and the time and day at which an immediately preceding image-formation processing was complete. Also, it is arranged that, by the power's being also supplied from a backup power supply during a period of time, as well, in which the power source of the main body is made "OFF", detecting the relative humidity and recording the history of changes in that humidity into the non-volatile memory 108 be executed. The I/O port 109 is an input/output port. It has connected thereto various kinds of devices or means such as the humidity sensor 91 and time counter part 93. The time counter part 93 functions to perform a time/day counting operation and, while the power source of the main body is turned "OFF", is driven by the backup power supply.

Next, the warming-up operation of the image forming apparatus as well as the image correction operation will be explained.

First, the image correction that the actual measurement image correction means 112 performs (hereinafter also called "the actual measurement image correction") will be explained. The actual measurement image correction means 112 forms on the photosensitive drum 43 a plurality of electrostatic latent images using test images (what is called "patches") that are predetermined, then develops each of them under a different developing condition, and detects the concentration of it using the concentration-detecting means 92. According to this detected result, there is determined the developing condition that makes it possible to obtain an optimum concentration. It is arranged that image correction be performed according to that determination.

Also, when image-formation processing wherein an image is actually recorded on the transfer sheet of paper is executed, actual measurement image correction is executed utilizing the empty area on the photosensitive drum 43. The actual measurement image correction that is executed during image-formation processing is simplified. For example, only one piece of patch is formed per image-formation processing. Also, it is arranged that, each time that image-formation processing is executed over several pages (for example 10 pages), the actual measurement image correction that is simplified be executed once. The most recent value for the developing conditions that has been determined through the actual measurement image correction operation is stored into the non-volatile memory 108.

Figure 1:
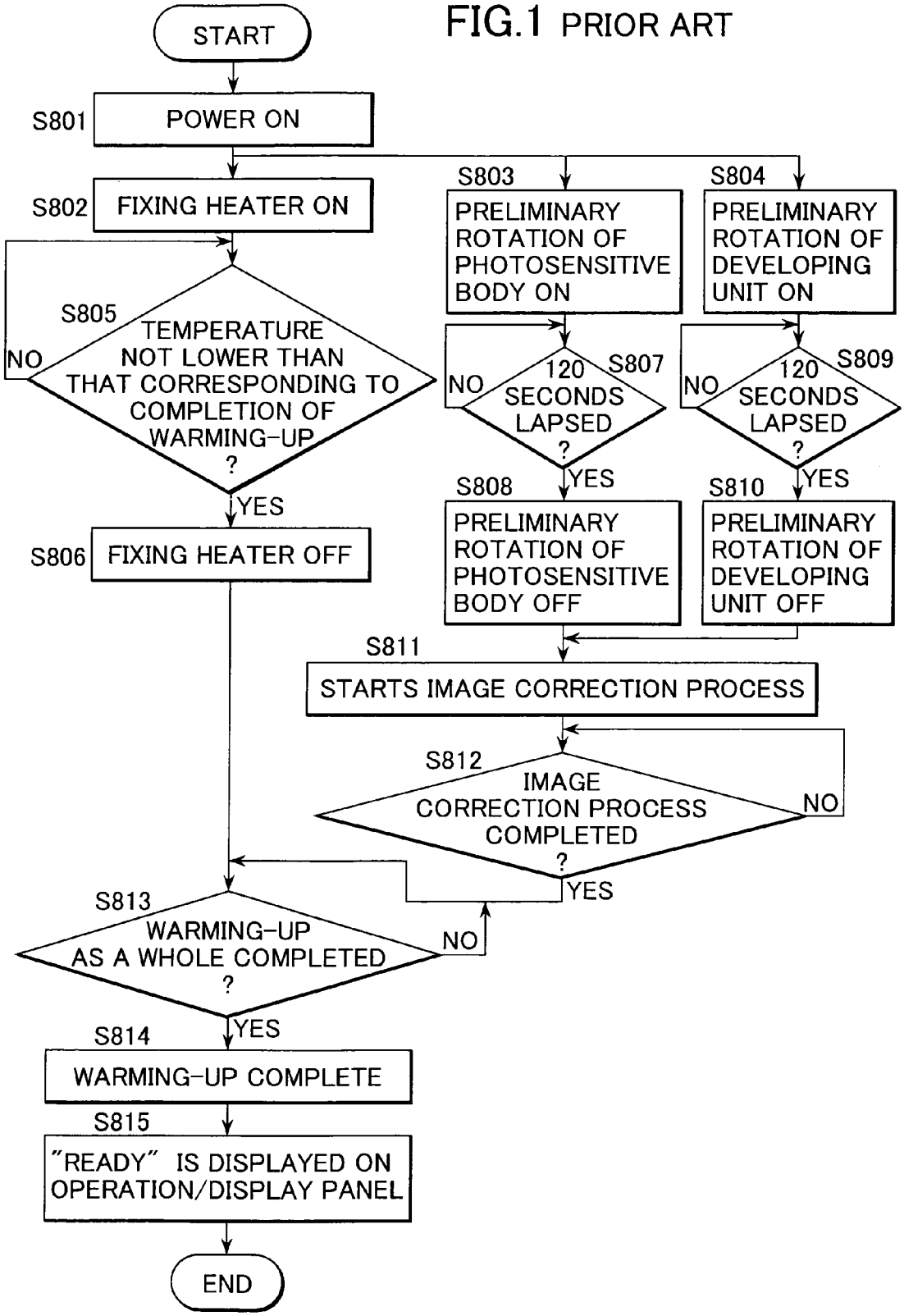
FIG.1 PRIOR ART
FIG. 1 is a flow chart illustrating an example of the warming-up operation that is performed after the power is turned "ON" in a conventional image forming apparatus.
Figure 2:
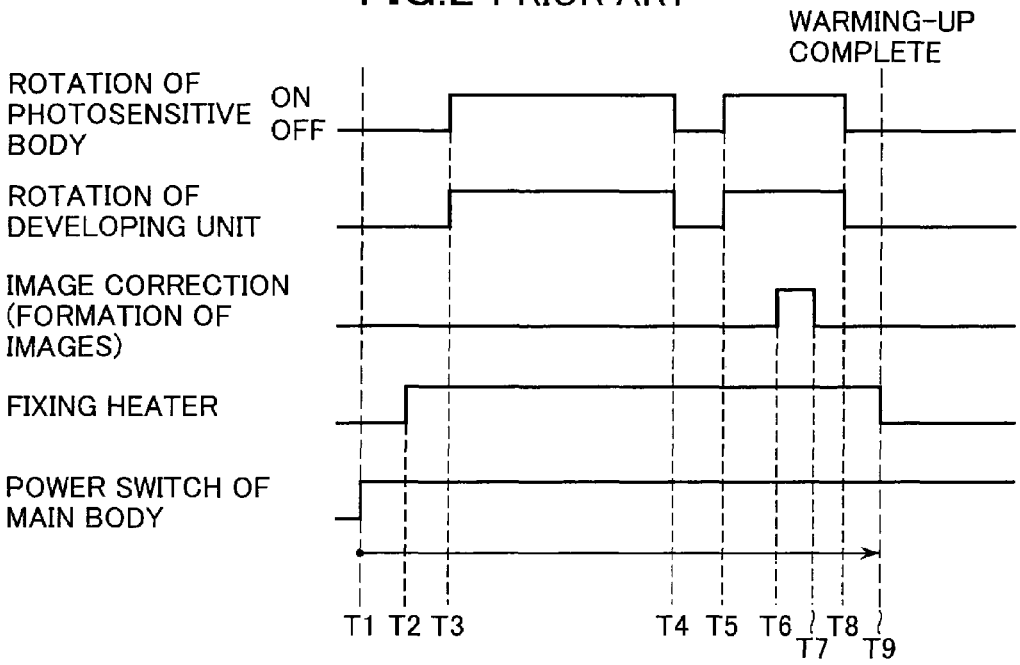
FIG.2 PRIOR ART
FIG. 2 is a timing chart, relevant to the operation performed after the power is turned "ON" in the conventional image forming apparatus, illustrating the operation in each part in a case where the correction of an image followed by the formation of it is complete during the warming-up period of fixing operation.
Figure 3:
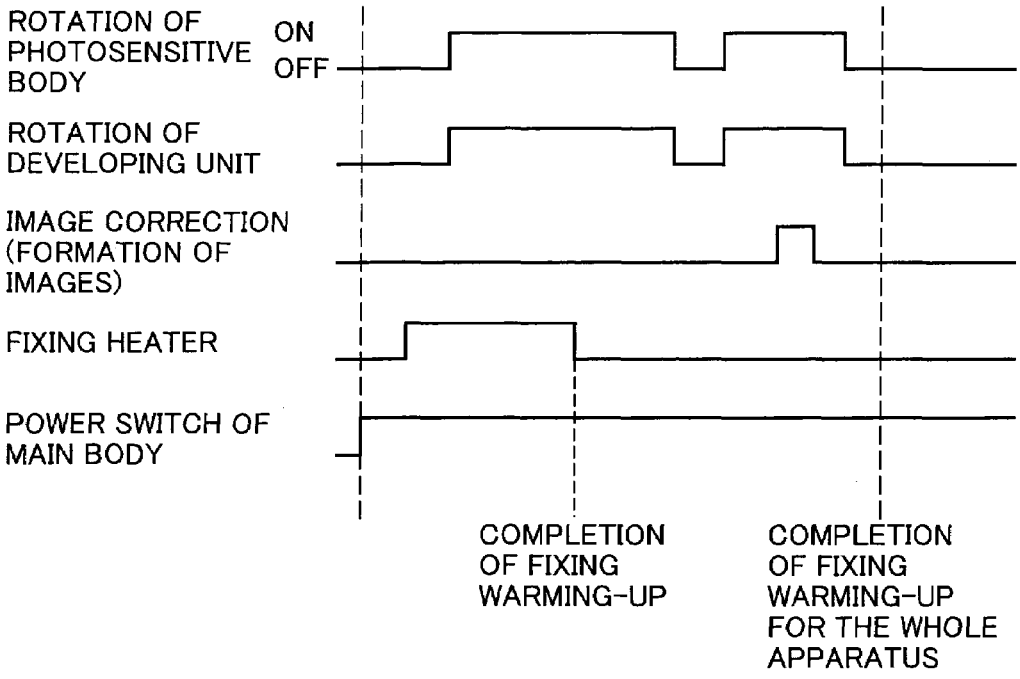
FIG.3 PRIOR ART
FIG. 3 is a timing chart, relevant to the operation performed after the power is turned "ON" in the conventional image forming apparatus, illustrating the operation in each part in a case where the correction of an image followed by the formation of it is not complete during the warming-up period for fixing operation.
Figure 4:
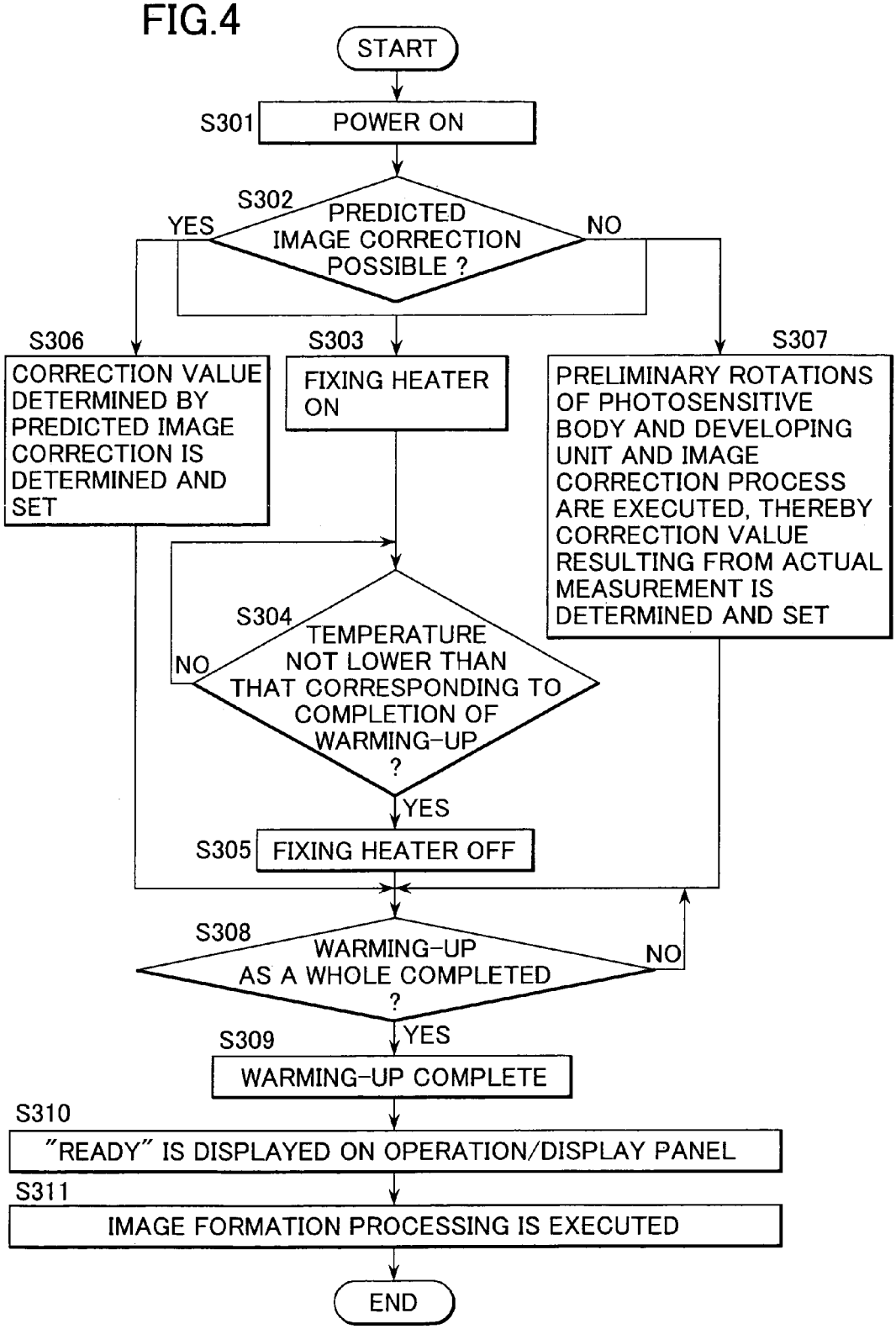
FIG. 4 is a flow chart illustrating the operation such as the warming-up operation that is performed by an image forming apparatus according to a first embodiment of the present after the power is made "ON"

FIG. 4 illustrates the flow of operation after the power is made "ON" in the image forming apparatus 10 according to the first embodiment. In the first embodiment, in order to somewhat victimize ensuring the fixability of toner to consecutive passed papers (for example, several hundred transferred papers) after the fixing unit is warmed up and thereby shorten the warming-up time period for the fixing unit, the fixing rollers are each made thin 1 millimeter or less. As a result, the warming-up time period for the fixing unit 80 is shortened to approximately 30 seconds to approximately 1 minute.

In the above-described image forming apparatus 10, when the power is made "ON" (step S301 in FIG. 4), it is first determined whether predicted image correction is possible (step S302). If not possible (step 302; N), the fixing unit 80 starts to be warmed up (step S303) and simultaneously the preliminary rotation operations of the photosensitive drum 43 and developing unit 50 are performed. Thereafter, the actual measurement image correction means 112 performs actual measurement image correction. And the developing conditions that have been determined by the actual measurement image correction are set as the developing conditions that will be used in performing the succeeding image-formation processing (step S307). Here, it is arranged that, after the preliminary rotation operations of the photosensitive drum 43 and developing unit 50 are performed for 120 seconds, actual measurement image correction be executed.

FIG. 7 illustrates an example of a determination table 400 that is referred to when it is determined in the step S302 in FIG. 4 whether predicted image correction is possible. The determination table 400 shows the "possible" or "impossible" of the predicted image correction during the time period in which the operation of the apparatus is left standing without the image-formation processing's therein being executed, in accordance with both the relative humidity-unique evaluation and the allowing-to-stand time length-unique evaluation. The mark "o" indicates that predicted image correction is "possible" while the mark "x" indicates that that is "impossible".

When the photosensitive body is left standing in a high-humidity level of environment for a long period of time, the phenomenon that the images laterally flow (the phenomenon termed "image blur") takes place. This phenomenon takes place due to the fact that, when a portion of water attaches onto the surface of the photosensitive body, the electrical resistance in the width direction of the surface of the photosensitive body gets decreased and in consequence the electric charge involved moves in that width direction. The policy with respect to this phenomenon is eliminating the portion of water that has attached onto the surface, in advance, by preliminarily rotating the photosensitive body (eliminating it by rubbing with the blade of the cleaning unit 48). Even if changing the developing conditions, the phenomenon "image blur" is not improved. Also, as described later in this description, it is arranged that, when executing predicted image correction, preliminarily rotating the photosensitive drum 43 and developing unit 50 be not executed. For this reason, the status of occurrence of the "image blur" is examined uniquely for allowing-to-stand time period and uniquely for relative humidity, in advance. According to the results obtained, the determination table 400 is set so that, under the condition that "image blur" is expected to occur, predicted image correction becomes impossible to execute.

Accordingly, in the step S302, the time and day when the immediately preceding image-formation processing finished being executed is read out from the non-volatile memory 108. Then the allowing-to-stand period of time is determined from the difference between that time and day and the current time and day that the time counter part 93 indicates. Also, an average value of relative humidity is determined according to the history of change in the relative humidity that is stored in the non-volatile memory 108. Referring to the determination table 400 according to that relative humidity and allowing-to-stand period of time, it is determined whether predicted image correction is possible.

The warming-up operation of the fixing unit 80 is terminated when the fixing unit 80 has increased up to a prescribed temperature for completion of the warming-up (for example 180° C.) (step S304; Y). And, the fixing unit 80 is made "OFF" (step S305). As explained previously, in this embodiment, the warming-up of the fixing unit 80 is complete after the passage of approximately 30 seconds to approximately one minute. Therefore, in a case where predicted image correction is impossible, warming-up for fixing is first complete and then, at the point of time when actual measurement image correction has finished being executed, warming up the apparatus as a whole is complete (step S308; Y and step S309).

In a case where it has been determined that predicted image correction is possible (step S302; Y), the warming-up operation for the fixing unit 80 starts to be performed (step S303). Simultaneously, predicted image correction is executed (step S306). In the predicted image correction, the preliminary rotation operation of the photosensitive drum 43 and developing unit 50 and the image correction operation followed by forming an image using and from a test image are not performed. Developing capability of the developer is instead controlled using estimation. The amount of electric charge that has entered the developer fluctuates depending on the allowing-to-stand length of time and the allowed-to-stand environment (humidity). Namely, when natural discharge of electricity occurs in the developer due to a long allowing-to-stand period of time and the amount of electric charge that has entered decreases, "development in excess" results. In the case where predicted image correction is determined as being impossible to execute, since the preliminary rotation operation of the developing unit 50 is performed, the operation of agitating the developer is sufficiently performed within the developing unit 50. As a result of this, the amount of electric charge that has entered increases up to a stable value, with the result that the developing capability becomes stabilized.

On the other hand, in the predicted image correction operation, the preliminary rotation operations of the photosensitive drum 43 and developing unit 50 are not executed. Therefore, it is arranged that the amount of increase in the developing capability which occurs due to the decrease in the amount of electric charge that occurs due to the long allowing-to-stand inaction be corrected by using either the policy of "decreasing the speed ratio" or the policy of "decreasing the developing electric field" or in the way that both the policies are combined together. Here, the increase in the developing capability is corrected by adjusting the speed ratio between the rotation speed of the developing sleeve 52 and that of the photosensitive drum 43. The amount of correction is represented in a value that is taken relative to the developing conditions that were set according to the immediately preceding actual measurement image correction. Also, the amount of correction is determined according to the allowing-to-stand length of time that is counted from the point of time when the agitating operation of the developing unit 50 was previously terminated as well as to the humidity conditions that come up during that allowing-to-stand length of time.

FIG. 8 illustrates an example of a correction table 420 for correcting the speed ratio. The correction table 420 illustrates the amounts of correction uniquely to the allowing-to-stand length of time as counted from the point of time when the immediately preceding image-formation processing has been terminated and uniquely to the relative humidity during that allowing-to-stand length of time. The amount of correction that is indicated by "0" means adopting the speed ratio that is the same as that which was used when the immediately preceding actual measurement image correction was executed. "0.05" means decreasing the speed ratio by 0.05 based upon the immediately preceding value. Also, in the correction table 420, it is arranged that 0.05 be set as being one step and that the amount of correction be varied every step mentioned.

In the predicted image correction in the step S306, the time and day when the immediately preceding image-formation processing was terminated are read out from the non-volatile memory 108. Then the allowing-to-stand length of time is determined from the difference between that time and day and the current time and day that the time counter part 93 indicates. Also, an average value of relative humidity is determined from the history of change in the relative humidity that is stored in the non-volatile memory 108. Referring to the correction table 420 according to this relative humidity and the allowing-to-stand length of time, the amount of correction for the speed ratio is determined. Further, the speed ratio that was used in the immediately preceding actual measurement image correction is read out from the non-volatile memory 108. Then the speed ratio that was used in the predicted image correction is determined from that speed ratio and the amount of correction that has previously been determined. Thereby processing wherein that speed ratio is set as the developing conditions that are used for a succeeding image formation processing is executed.

As described above, since no preliminary rotation operation of the photosensitive drum 43 and developing unit 50, as well as no test image formation operation, follow the predicted image correction, this correction finishes being performed in a sufficiently short length of time as compared to warming up the fixing unit 80. For this reason, in a case where it has been determined that predicted image correction is possible (step S302; Y), the point of time when warming-up is complete as the apparatus as a whole becomes the point of time when warming up the fixing unit 80 is complete (step S308; Y and step S309). Namely, the warming-up length of time for the fixing unit 80 determines, or controls, the warming-up length of time for the apparatus as a whole. Namely, the effect of shortening the warming-up length of time for the fixing unit 80 due to thinning the structure thereof directly contributes to shortening the warming-up length of time for the apparatus as a whole.

Upon completion of the warming-up of the apparatus as a whole (step S309), a display to the effect that the apparatus has become possible to use is made on the display part 221 of the operation/display part 220 (step S310). A message such as "ready to copy" is displayed. The image formation processing that is thereafter executed (step S311) will be done using the developing conditions that have been set in the predicted image correction in the step S306 or in the actual measurement image correction in the step S307.

Figure 9:
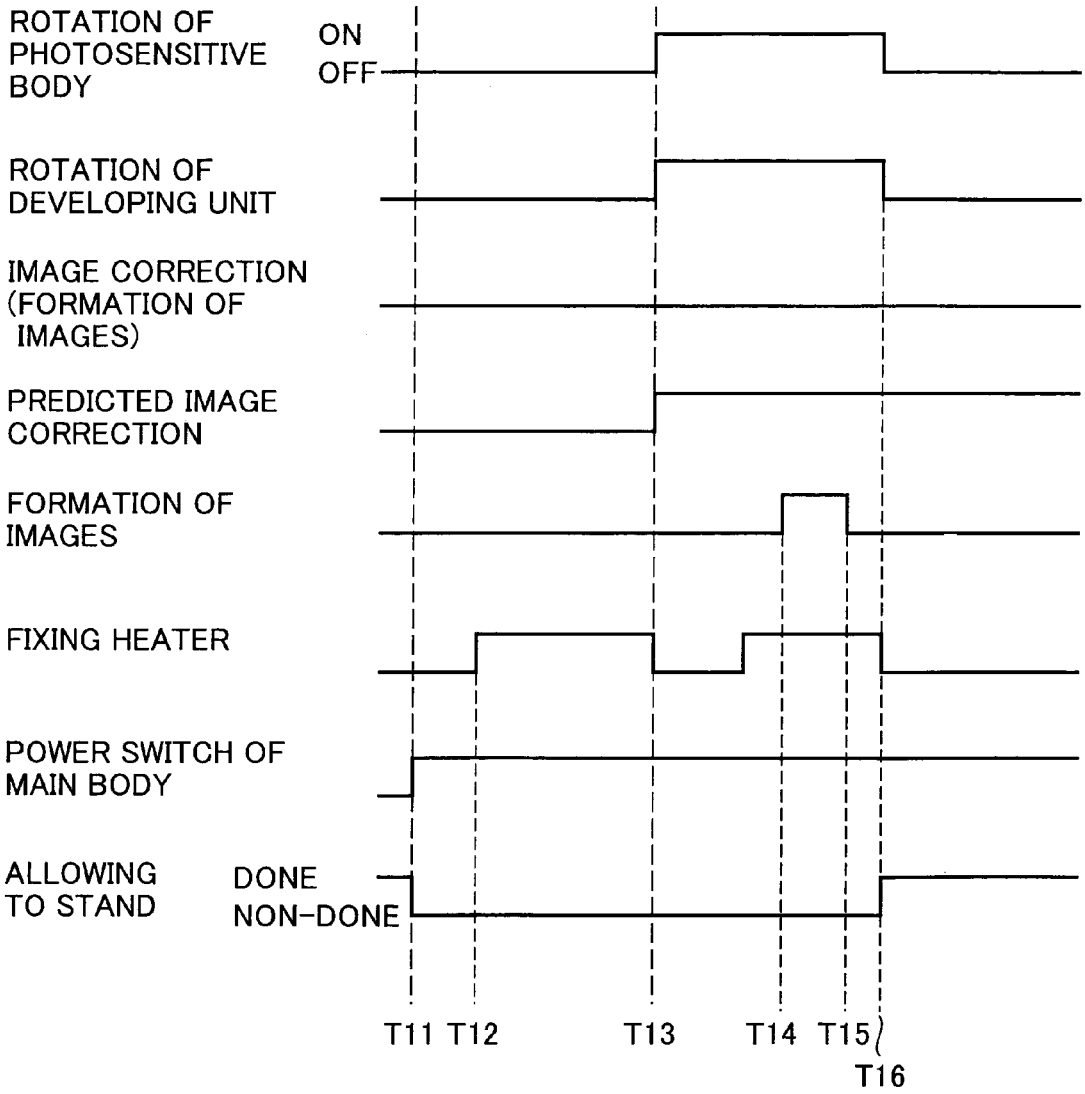
FIG. 9 is a timing chart illustrating the operation in each part after the power is made "ON" in a case where correction to an estimated image is made in the image forming apparatus according to the first embodiment of the present invention.

FIG. 9 illustrates the operational timing for each operation part after the power source is made ON in the case where predicted image correction has been executed. At a point of time T11 the power source is made ON and, at a point of time T12 that is immediately thereafter warming up the fixing unit 80 starts to be performed. At time T13 warming up the whole apparatus finishes being performed. Here, since predicted image correction has been executed, there are not executed during the period from the time T11 to time T13 the preliminary rotation operations of the photosensitive drum 43 and developing unit 50 and the image correction followed by formation of images.

When the warming-up operation finishes being performed at time T13, the developing conditions for performing the predicted image correction become active. Also, in this example, image formation processing such as a copying operation has started to be performed simultaneously with the completion of the warming-up operation. Namely, following the image formation processing, not only the photosensitive drum 43 but also the developing unit 50 is rotated over a time period from time T13 to time point T16. In addition, formation of images is executed over a time period that is midway between time T14 and time T15. Also, from the closure of the power source until time T16 when the image formation processing is terminated, "allowing-to-stand is non-done" and, from time T16 onward, the time period for the "allowing-to-stand is done" starts again.

Meanwhile, when executing the image formation processing such as copying operation, the developing unit 50 rotates and the developer is thereby agitated. Therefore, the charged amount of electricity in the developer gradually increases. Thereupon, it is advisable to decrease the amount of correction for the predicted image correction according to the time length for which the image formation processing has been executed and/or the number of transferred papers (the number of printed papers) with respect to which image formation processing was executed. For example, the amount of correction is decreased, every time that 200 papers have been printed, or every time that image formation processing has been executed for 1 minute, step by step, until it becomes "0".

Also, when executing predicted image correction, there is prohibited any of the preliminary rotation operations of the photosensitive drum 43 and developing unit 50 during warming up the fixing unit 80 and the image correction operation followed by formation of images. Therefore, by utilizing that power corresponding thereto for heating the fixing unit 80, it is attempted to shorten the warming-up length of time for the fixing unit 80. Namely, as the driving mode for the fixing unit 80, there are provided an ordinary mode and a high-power mode in which the power supplied is more increased than in the ordinary mode. In a case where executing the warming-up for executing the predicted image correction, warming-up the fixing unit 80 after the power source is turned ON is executed in the high-power mode. In a case where it is determined that predicted image correction is impossible to execute actual measurement image correction, warming up the fixing unit 80 is executed in the ordinary mode.

Next, a second embodiment of the present invention will be explained. In the second embodiment, it is arranged that, when, after warming up the apparatus for the predicted image correction has finished being executed, a prescribed allowing-to-stand length of time (for example 1 minute) or a length of time that is greater than prescribed has gone on passing, the preliminary rotation operation and actual measurement image correction be executed.

Also, the operation that will be performed until warming up the apparatus as a whole finishes being performed and a display is made to the effect that the apparatus has become ready to use is the same as that which is illustrated in FIG. 4 (step S501 to step S508). After warming up is complete, if image formation processing is instructed, by the user, to get started, it is executed (step S510). On the other hand, in a case where the operation of the apparatus has been left standing after completion of warming-up or execution of the image formation processing, it is arranged that counting the continuation time length for which the apparatus is left standing as is be performed. And, when the status of allowing-to-stand goes on for a prescribed, or greater than prescribed, length of time (step S509; Y), it is determined that there exists no user who wants to execute the printing operation immediately. Then the preliminary rotation operations for the photosensitive drum 43 and developing unit 50 and the actual measurement image correction operation are executed (step S511 to step S518). Upon completion of the actual measurement image correction operation (step S518; Y), the value of correction that has been determined by the actual measurement image correction this time is set as the developing conditions that will be used in the thereafter succeeding image formation processing (step S519)

Figure 11:
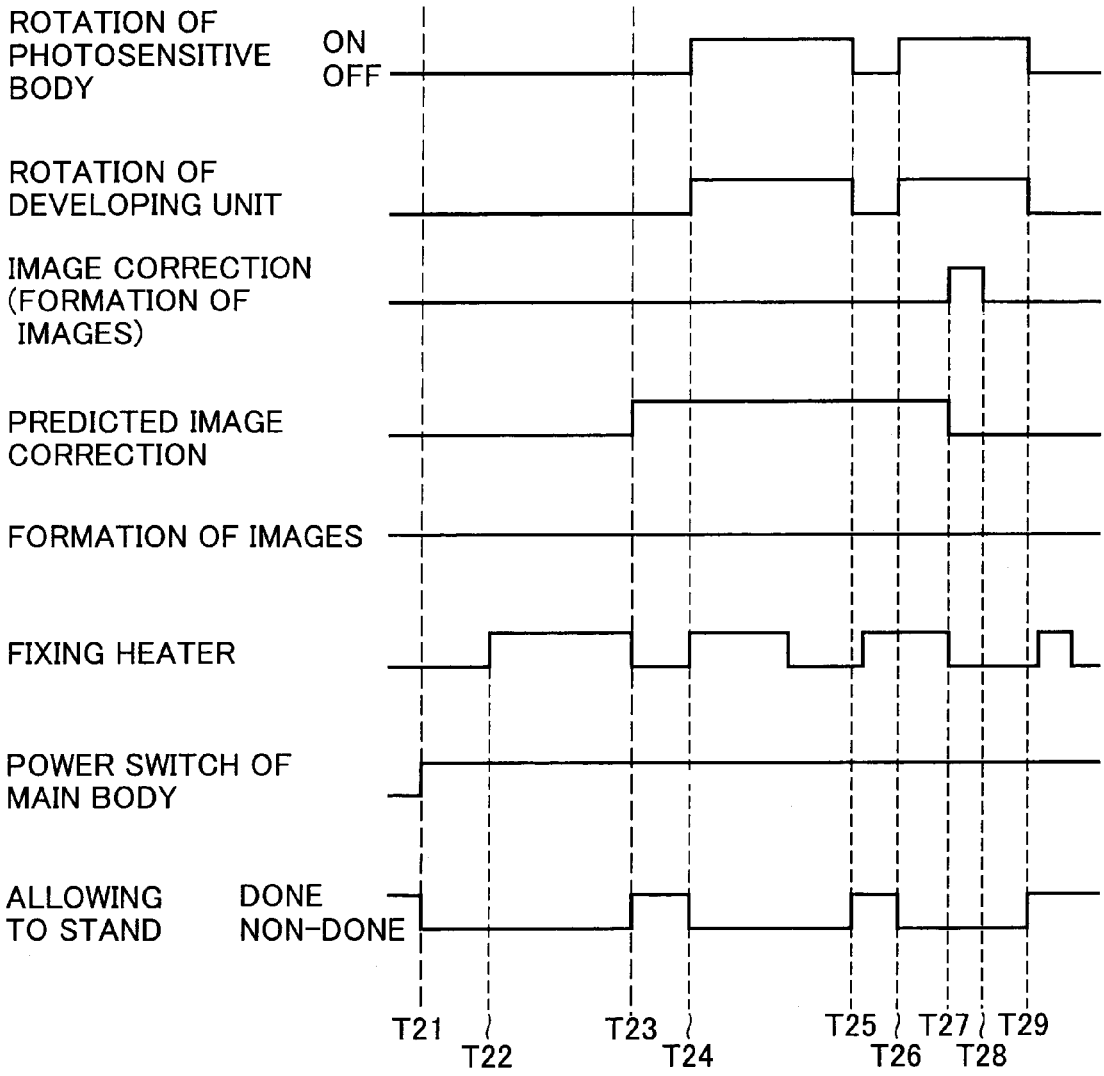
FIG. 11 is a timing chart illustrating the operation in each part that is performed in a case where, in the image forming apparatus according to the second embodiment of the present invention, a status in which the operation is left standing as is during not shorter than a prescribed length of time goes on after the apparatus is warmed up and before image-forming is executed and where, for that period of time, preliminary rotation operation and actual measurement image correction have been executed.

FIG. 11 illustrates the operational timings for the respective parts in a case where a status of allowing-to-stand has continued for a prescribed, or greater than prescribed, length of time after completion of warming-up of the whole apparatus and before execution of the image formation processing and the preliminary rotation operation and actual measurement image correction have been executed. At a point of time T21, the power is turned ON. At the immediately succeeding point of time T22, the fixing unit 80 begins being warmed up. At time T23, warming up the whole apparatus finishes being performed. Here, since predicted image correction is performed, no preliminary rotation operation for the photosensitive drum 43 and developing unit 50 as well as no image correction operation followed by the formation of images is executed during the time period from time T21 to time T23.

Since after warming-up has completed at time T23 a status of allowing to stand has continued until time T24, during a time period of 120 seconds from time T24 to time T25 the preliminary rotation operation for the photosensitive drum 43 and developing unit 50 are executed. After that, the photosensitive drum 43 and developing unit 50 perform their respective rotation operations from time T26 to time T29 for performing the actual measurement image correction. And, during a time period from time T27 to time T28 that is midway between time T26 and time T29, formation of images is performed using a test image. Also, correcting the developing conditions by the predicted image correction is interrupted at the point of time T27 at which formation of images by the actual measurement image correction is started. Upon completion of the actual measurement image correction at time T29, in the image formation processing that succeeds thereafter, the developing conditions that have been determined by that actual measurement image correction are used.

As described above, even when warming-up that follows after the power source is made ON has completed, image formation processing is not executed immediately thereafter. Instead, after a status of allowing to stand has continued for a prescribed, or greater than prescribed, length of time, the preliminary rotation operation such as the photosensitive drum 43 and the actual measurement image correction operation are executed. Therefore, it is possible to perform more accurate and reliable image correction without keeping the user waiting.

Figure 12:
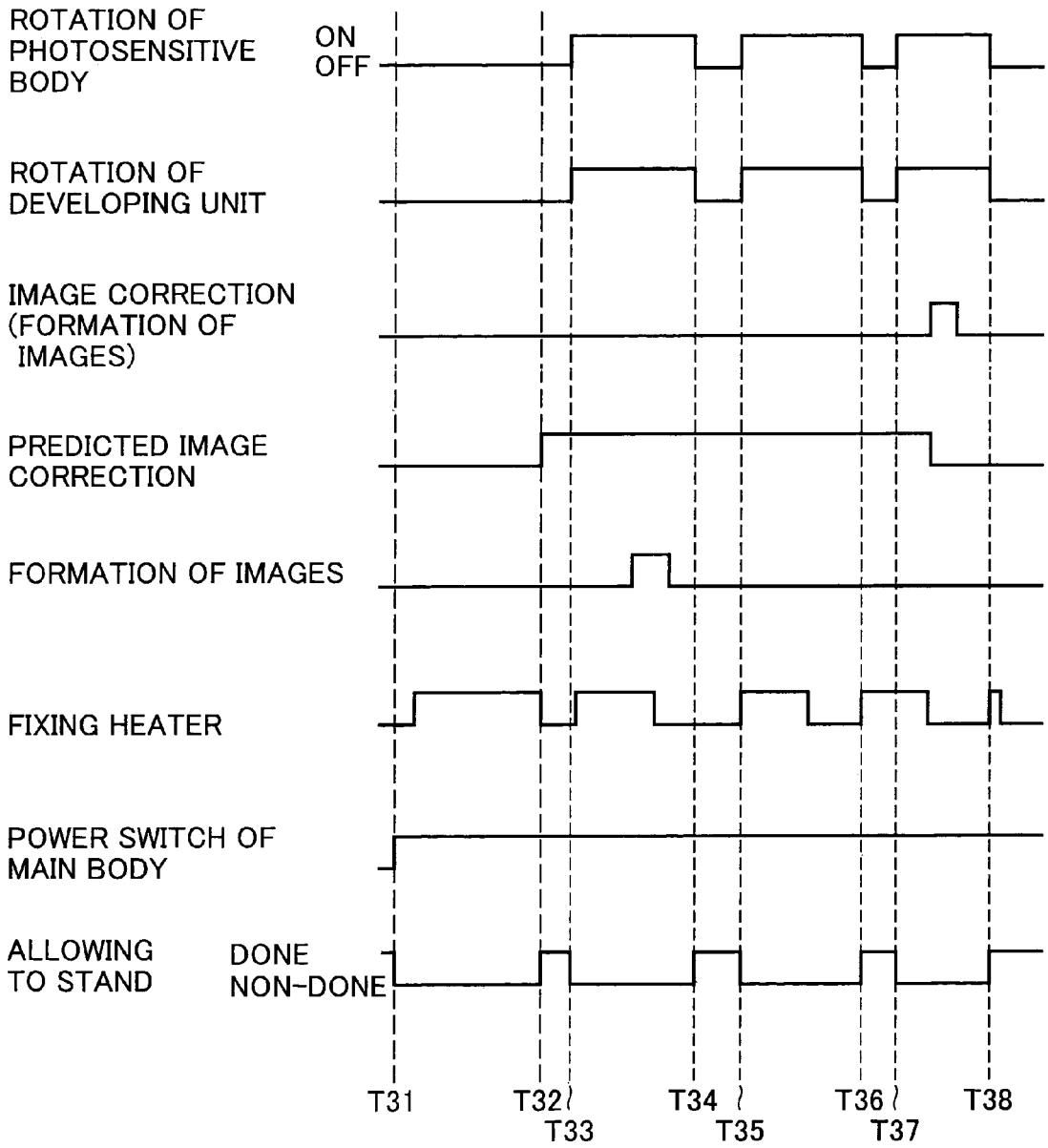
FIG. 12 is a timing chart illustrating the operation in each part that is performed in a case where in the image forming apparatus according to the second embodiment of the present invention image formation processing is executed immediately after the apparatus has finished being warmed up and where, thereafter, a status in which the operation is left standing during not shorter than a prescribed length of time goes on and where, as a result of this, preliminary rotation operation and actual measurement image correction are performed.

FIG. 12 illustrates the operational timing for the respective parts in a case where image formation processing is executed immediately after the warming-up operation is complete and, thereafter, as a result of the fact that the status wherein the apparatus operation is left standing has continued for a prescribed, or greater than prescribed, length of time, the preliminary rotation operation and actual measurement image correction have been executed. At a point of time T31, the power source becomes ON and, at a point of time T32, warming up the apparatus as a whole is complete. Thereafter, before a status in which the apparatus operation is allowed to stand continues for the prescribed length of time, image formation processing is executed over the period of time from time T33 to time T34. This image formation processing is executed using the amount of correction with respect to the predicted image correction. After that, since the status of allowing to stand continued over the prescribed, or greater than prescribed, length of time from time T34 at which the image formation processing had ended until time T35, the preliminary operation such as the photosensitive drum 34 is executed from time T35 to time T36. Subsequently, actual measurement image correction operation is executed over a time period from time T37 to time T38.

In the image formation processing that is executed soon after warming-up, there are used the developing conditions that are used when actual measurement image correction is executed. Therefore, the warming-up length of time for the apparatus as a whole is shortened and therefore it becomes possible to execute image formation processing without keeping the user waiting long after the power source is made ON. On the other hand, in a case where after completion of image formation processing the status of allowing-to-stand has continued for a prescribed, or greater than prescribed, length of time, actual measurement image correction is executed. Therefore, the image formation processing that will be executed thereafter becomes possible to execute under the developing conditions that are more accurate.

Next, a third embodiment of the present invention will be explained. In the third embodiment, in a case where image formation processing such as copying operation is executed after completing warming up the apparatus as a whole and before executing the actual measurement image correction, it is arranged to shorten, according to the length of time during which that processing is executed, the executing length of time for the preliminary rotation operation such as the photosensitive drum 43 that is to be executed before executing the actual measurement image correction. During the image formation processing, as well, such as copying operation, the photosensitive drum 43 and developing unit 50 are each rotated as in the case of the preliminary rotation operation. Therefore, by the extent that corresponds thereto, the executing length of time for the preliminary rotation operation that is to be executed before executing the actual measurement image correction is shortened.

FIG. 13 illustrates the flow of the operations that have been described above. The operations before the status of allowing to stand continues for a prescribed, or greater than prescribed, length of time are the same as those which are performed until the step S501 to the step S509; Y in FIG. 10. Therefore, describing and explaining them are omitted. In FIG. 13, there is illustrated the flow of processing operations that follows, or occurs, after (Y) determination has been made in the step S509 in FIG. 10. First, there is determined an added-up executing length of time for the image formation processing that was executed by the point of time when the status of allowing to stand continues for a prescribed, or greater than prescribed, length of time. Then it is determined (step S601) whether that executing length of time is equal to or greater than a necessary length of time (here 2 minutes) for preliminary rotation operation. In a case where the added-up executing length of time for image formation processing is equal to or greater than the necessary length of time for preliminary rotation operation (step S601; Y), the actual measurement image correction operation is immediately executed (step S609 to step S611) without executing the preliminary rotation operation for the photosensitive drum 43 and developing unit 50.

On the other hand, in a case where the added-up executing length of time for image formation processing is smaller than the necessary length of time for preliminary rotation operation (step S601; N), there is determined as a remaining length of time the difference between the necessary length of time for preliminary rotation operation and the added-up executing length of time (step S602). Then the preliminary rotation operation for the photosensitive drum 43 and developing unit 50 are executed during a time period that corresponds to that remaining length of time (steps S603 to S608). It is arranged that upon finish of the preliminary rotation operation the actual measurement image correction be subsequently executed (step S609 to step S611).

While the respective embodiments of the present invention have been described as above, concrete constructions thereof are not limited thereto. Even if changes, modification, or additions can be made without departing from the subject matter of the invention, they are included under the category of the invention. For example, in the above-described embodiment, during warming up for fixation that follows making the power source ON there has been prohibited any of the preliminary rotation operation for the photosensitive drum 43 be executed in parallel with the warming-up operation for fixation. Namely, although the phenomenon of "image blur" that occurs due to the attachment of a water portion onto the surface of the photosensitive drum is not solved even by changing the developing conditions, if executing the preliminary rotation operation for the photosensitive drum 43 during warming-up for fixation and in parallel therewith, the "image blur" is improved by the water portion's being eliminated to that extent.

On the other hand, it is not preferable that the preliminary rotation operation for the developing unit 50 be executed in parallel with the warming-up for fixation by strictly limiting the period of this execution to until completion of the fixing warming-up operation. Executing the preliminary rotation operation for the developing unit 50 causes the increase in the amount of electricity involved in the developer according to the length of time in which to do that execution. However, in the state of transition before the amount of electricity sufficiently increases, this amount is likely to become unstable. Accordingly, when the preliminary rotation operation for the developing unit 50 is executed by limiting this execution to within the fixing warming-up period of time, it becomes difficult to estimate the amount of electricity involved in the developer. This can contrarily decrease the accuracy with which the predicted image correction performs correction.

However, if able to appropriately determine, for example, by experiments, the relationship between the executing length of time for the preliminary rotation operation for the developing unit 50 and the rise characteristic of the amount of electricity involved in the developer, the preliminary rotation operation for the developing unit 50 may be executed in parallel with warming up by limiting this executing length of time to until the warming-up of the fixing unit 80 is complete. If executing the preliminary rotation operations for both the photosensitive drum 43 and the developing unit 50 during the fixing warming-up operation that follows making the power source ON, it becomes possible to shorten the executing length of time for the preliminary rotation operation that becomes needed when the actual measurement image correction is performed later.

Also, in a case where executing the preliminary rotation operation for the photosensitive drum 43 until the fixing warming up is complete and in parallel therewith, it may be arranged that predicted image correction be always executed without determining after the power is made ON whether predicted image correction is possible referring to the determination table 400. For example, if 30 second to 1 minute or so is needed to execute the fixing warming-up operation, even when simply causing preliminary rotation of the photosensitive drum 43 during that time period, the occurrence of the "image blur" can be almost prevented. This eliminates the necessity of determining on the "possible" or "impossible" of the predicted image correction.

In the above-described embodiment, for supplementing the deficiency in the increase in the amount of electric charge that enters the developer, predicted image correction has been executed by adjusting the rotation speed (the speed ratio between the photosensitive drum 43 and the developing sleeve 52) of the developing speed 52. However, it may also be arranged that this purpose be attained by adjusting the developing electric field. Furthermore, predicted image correction may be executed by combining the adjustment of the speed ratio and that of the developing electric field together.

Incidentally, although correcting the developing conditions can also be adjusted by the amount of toner that is supplementarily supplied to the developing unit 50, this technique becomes likely to easily cause the occurrence of the phenomenon (the so-called "photographic fog") that toner inconveniently attaches onto the portion that should be kept non-printed. Therefore, it is preferable to adjust with the rotation speed (speed ratio) of the developing sleeve.

In the above-described embodiment, determining the "possible" or "impossible" evaluation with respect to the predicted image correction as well as determining the amount of correction that is obtained therefrom has been performed taking both the allowing-to-stand length of time and the environmental conditions (relative humidity) into consideration. However, for example, it may be assumed that, regarding the relative humidity, it falls within a general range of percentage (from approximately 30 to approximately 60%). Under this assumption, the amount of correction by the predicted image correction may be determined according only to the allowing-to-stand time period.

Also, in the above-described embodiment, it has been arranged that the respective functions of the predicted image correction means 111 and actual measurement image correction means 112 be taken charge of by the main control unit. However, it may also be arranged that the printer controller 230 in the printer unit 40 perform these functions.

According to the image forming apparatus of the present invention, the developing conditions that are used when visualizing the electrostatic latent image on the electrostatic latent image carrier are corrected according to the time length that has lapsed since the immediately preceding image formation processing was executed, or to that time length and developing conditions. Therefore, compared to forming a toner image of a test image and thereby correcting the developing conditions, the time length needed to perform correction is shortened. Namely, it is possible to obtain an appropriate quality of output image without keeping the user waiting long after making the power source ON.

In the arrangement wherein predicted image correction is executed instead of prohibiting during warming-up one, or a plurality of, or all, operations of the preliminary rotation operation for the electrostatic latent image carrier, preliminary agitating operation for the developer, and actual measurement image correction operation, the warming-up time length for the apparatus as a whole is determined depending on the warming-up time length for fixation. As a result, it is possible to shorten the warming-up time length for the apparatus as a whole by the decrease in the fixing warming-up time length.

In the arrangement wherein when an allowing-to-stand length of time has first continued for a prescribed, or greater than prescribed, length of time after completion of the warming-up there is executed the image correction operation followed by the by-estimation rotating operation and formation of images, by-estimation rotating operation, etc. are executed during a time period in which the possibility of the user's immediately requesting the execution of image formation processing is thought low. Therefore, it is possible to execute actual measurement image correction operation without causing the user to suffer from any inconvenience.

In the arrangement wherein, when the image formation processing performed as predicted image correction has been performed, the executing length of time for the preliminary rotation operation and preliminary agitating operation following the image correction operation that thereafter occurs is shortened by that extent, the length of time that is required until the image correction operation finishes while a necessary rotation-operation length of time is ensured is shortened. Therefore, the possibility that during that time period a request to execute image formation processing will be issued from the user decreases with the result that keeping the user waiting becomes lessened.

In the arrangement wherein it is determined, according to the time length that has lapsed since executing the immediately preceding image formation processing and the environmental conditions, whether predicted image correction should by executed by prohibiting during the fixing warm-up the execution of the preliminary rotating operation and actual measurement image correction operation or preliminary rotation operation and actual measurement image correction-operation should be executed during the fixing warming-up, it is possible to execute warming-up in an appropriate mode of operation by presumably determining the occurrence or non-occurrence of image degradation that cannot be corrected by executing predicted image correction.

In the arrangement wherein the power for being spent for warming up the fixing means is increased in an amount that corresponds to having prohibited the preliminary rotation operation, etc. during the fixing warming-up, it is possible to further shorten the length of time for fixing warming-up operation.

In the arrangement wherein preliminary rotating operation for the electrostatic latent image carrier is executed during warming up the fixing means, it is possible to mitigate the degradation of image due to the "image blur" that cannot be corrected using the developing conditions.

In the arrangement wherein the amount of correction by the predicted image correction is determined according to the immediately preceding amount of correction that had been determined by the actual measurement image correction, it is possible to enhance the correction accuracy with which image correction is made by the predicted image correction.

In the arrangement wherein the value of correction by the predicted image correction is adjusted according to the length of time during which there has been executed the image formation processing based on the use of the value of correction by predicted image correction, the amount of correction is adjusted to an appropriate value that corresponds to the increase in the amount of electric charge, or electricity, involved in the developer that follows executing the image formation processing.

What is claimed is:

1. An image forming apparatus adapted to execute a series of image formation processing in such a way as to develop and make visible an electrostatic latent image that is formed on an electrostatic latent image carrier by using a developer layer that is carried on a developer carrier, to transfer the visualized image onto a recording medium, thereafter to eliminate the developer remaining on the electrostatic latent image carrier by using a cleaning unit, and to pass the post-transfer recording medium through fixing means for heating and pressurizing it to thereby perform adhering and fixing of the image, comprising:

predicted image correction means for correcting the developing conditions for visualizing the electrostatic latent image on the electrostatic latent image carrier on the basis of the length of lapse time that from an immediately preceding image formation processing or that length of time and the environmental conditions; and control means for controlling the flow of operation associated with the correction of the images, wherein the control means prohibits, during warming-up of the fixing means, one, or a plurality of, or all, operations of an actual measurement image correction operation that forms a visualized test image on the electrostatic latent image carrier and that, according to that test image, corrects the developing conditions for visualizing the electrostatic latent image formed on the electrostatic latent image carrier, a preliminary rotating operation for the electrostatic latent image carrier, and a preliminary agitating operation for the developer, thereby executing the image formation processing following the completion of warming-up of the fixing means by using a value of correction that is determined by the predicted image correction means.

2. An image forming apparatus according to claim 1, wherein the power spent for warming up of the fixing means is increased by the extent to which there are prohibited, during warming up the fixing means, one, or a plurality of, or all, operations of the preliminary rotation operation for the electrostatic latent image carrier, the preliminary agitating operation for the developer, and the image correction operation executed by the actual measurement image correction means.

3. An image forming apparatus according to claim 1, wherein the preliminary rotating operation for the electrostatic latent image carrier is executed during warming up of the fixing means.

4. An image forming apparatus adapted to execute a series of image formation processing in such a way as to develop and make visible an electrostatic latent image that is formed on an electrostatic latent image carrier by using a developer layer that is carried on a developer carrier, to transfer the visualized image onto a recording medium, thereafter to eliminate the developer remaining on the electrostatic latent image carrier by using a cleaning unit, and to pass the post-transfer recording medium through fixing means for heating and pressurizing it to thereby perform adhering and fixing of the image, comprising:

actual measurement image correction means for correcting the developing conditions for visualizing the electrostatic latent image formed on the electrostatic latent image carrier on the basis of a visualized test image formed on the electrostatic latent image carrier;

predicted image correction means for correcting the developing conditions on the basis of the length of lapse time from an immediately preceding image formation processing or that length of time and the environmental conditions; and control means for controlling the flow of operation associated with the correction of the images, wherein the control means prohibits, during warming-up of the fixing means, one, or a plurality of, or all, operations of a preliminary rotation operation for the electrostatic latent image carrier, a preliminary agitating operation for the developer, and an image correction operation performed by the actual measurement image correction means, and, when, after completion of warming-up of the fixing means, an allowing-to-stand period of time during which no image formation processing is performed or inputting an operation or inputting a from-outside printing command is not performed has first continued for a prescribed, or greater than prescribed, length of time, executes the image correction operation, or either one, or both, of the preliminary rotating operation and preliminary agitation operation and executes the image formation processing during the period from completion of warming-up of the fixing means until execution of the image correction operation by using a value of correction that is determined by the predicted image correction means.

5. An image forming apparatus according to claim 4, wherein the apparatus executes predicted image correction when input of an operation or a from-outside printing command signal has been accepted.

6. An image forming apparatus according to claim 4, wherein in a case where, before the allowing-to-stand length of time has first continued for the prescribed, or greater than prescribed, length of time, image formation processing is executed using the value of correction that is determined by the predicted image correction means, the executing length of time for the preliminary rotating operation and/or preliminary agitating operation following the image correction operation is shortened.

7. An image forming apparatus adapted to execute a series of image formation processing in such a way as to develop and make visible an electrostatic latent image that is formed on an electrostatic latent image carrier by using a developer layer that is carried on a developer carrier, to transfer the visualized image onto a recording medium, thereafter to eliminate the developer remaining on the electrostatic latent image carrier by using a cleaning unit, and to pass the post-transfer recording medium through fixing means for heating and pressurizing it to thereby perform adhering and fixing of the image, comprising:

actual measurement image correction means for correcting the developing conditions for visualizing the electrostatic latent image formed on the electrostatic latent image carrier on the basis of a visualized test image formed on the electrostatic latent image carrier;

predicted image correction means for correcting the developing conditions on the basis of the length of lapse time from an immediately preceding image formation processing was executed or that length of time and the environmental conditions; and control means for controlling the flow of operation associated with the correction of the images, wherein the control means prohibits, during warming-up of the fixing means, one, or a plurality of, or all, operations of a preliminary rotating operation for the electrostatic latent image carrier, a preliminary agitating operation for the developer, and an image correction operation performed by the actual measurement image correction means, and includes a first warming-up mode in which to execute the image formation processing following the completion of warming-up of the fixing means by using a value of correction that is determined by the predicted image correction means and a second warming-up mode in which to execute the image correction operation or the image correction operation followed by either one, or both, of the preliminary rotation operation and the preliminary agitating operation, and selects in which mode the apparatus should be started up according to the time length that has lapsed since an immediately preceding image formation processing was executed as well as the environmental conditions.

8. An image forming apparatus adapted to execute a series of image formation processing in such a way as to develop and make visible an electrostatic latent image that is formed on an electrostatic latent image carrier by using a developer layer that is carried on a developer carrier, to transfer the visualized image onto a recording medium, thereafter to eliminate the developer remaining on the electrostatic latent image carrier by using a cleaning unit, and to pass the post-transfer recording medium through fixing means for heating and pressurizing it to thereby perform adhering and fixing of the image, comprising:

predicted image correction means for correcting the developing conditions for visualizing the electrostatic latent image on the electrostatic latent image carrier on the basis of a length of lapse time from an immediately preceding image formation processing or that length of time and the environmental conditions; and actual measurement image correction means for correcting the developing conditions for visualizing the electrostatic latent image formed on the electrostatic latent image carrier on the basis of a visualized test image formed on the electrostatic latent image carrier;

wherein the predicted image correction means corrects the developing conditions on the basis of the immediately preceding value of correction that was previously determined by the actual measurement image correction means.

9. An image forming apparatus adapted to execute a series of image formation processing in such a way as to develop and make visible an electrostatic latent image that is formed on an electrostatic latent image carrier by using a developer layer that is carried on a developer carrier, to transfer the visualized image onto a recording medium, thereafter to eliminate the developer remaining on the electrostatic latent image carrier by using a cleaning unit, and to pass the post-transfer recording medium through fixing means for heating and pressurizing it to thereby perform adhering and fixing of the image, comprising:

predicted image correction means for correcting the developing conditions for visualizing the electrostatic latent image on the electrostatic latent image carrier on the basis of a length of lapse time from an immediately preceding image formation processing or that length of time and the environmental conditions, wherein the predicted image correction means adjusts the amount of correction on the basis of the length of time for which image formation processing has been executed using the value of correction previously determined by the predicted image correction means itself.

* * * * *